US005119546A

United States Patent [19]

Cameron et al.

[11] Patent Number: 5,119,546

[45] Date of Patent: Jun. 9, 1992

[54] ELECTRICAL HARNESS ASSEMBLY APPARATUS

[75] Inventors: John G. Cameron, Woodridge; Robert W. DeRoss, Naperville; Ronald Dudek, Orland Park; Steven F. Wright, Glen Ellyn; Hasmukh Shah; Robert Klemmer, both of Wheaton; Peter Ingwersen, Gilberts; Robert E. Erklin, Sr., Bedford Park; Robert A. Suthard, Woodridge, all of Ill.

[73] Assignee: Molex Incorporated, Lisle, Ill.

[21] Appl. No.: 621,176

[22] Filed: Dec. 3, 1990

Related U.S. Application Data

[63] Continuation-in-part of Ser. No. 392,808, Aug. 10, 1989.

[51] Int. Cl.[5] ..... H01R 43/00

[52] U.S. Cl. ..... 29/748; 21/705; 21/883; 21/749

[58] Field of Search ..... 29/747, 748, 749, 742, 29/705, 883, 884

[56] References Cited

U.S. PATENT DOCUMENTS 4,171,566 10/1979 Tominoi ..... 29/748

4,787,138 11/1988 Eaton et al. ..... 29/748

*Primary Examiner*—Carl E. Hall

*Attorney, Agent, or Firm*—Charles S. Cohen

[57] ABSTRACT

A system for manufacturing wire harness assemblies is provided. Each wire harness includes a shielded cable having a plurality of insulated conductors therein, with each conductor being terminated at its respective opposed ends and with the terminated ends being mounted in connector housings. The system includes a plurality of pallets that are movable along a conveyor to work stations at which various assembly steps are carried out. A first station is provided for mounting the cables to the pallet, such that the wires at the opposed ends are mounted in fixtures. A second station may selectively deposit drop wires into fixtures on the pallets. A third station trims and strips the ends of the wires and aligns the drop wires with the cable wires. A fourth station sequentially crimps terminals to the ends of the wires, with the pallet being indexable between successive crimps. The crimp apparatus adjusts to the required crimp height depending on the presence or absence of drop wires and the presence or absence of grounding clips. A fourth station tests for the presence of the terminals and inserts the terminated wires into housings.

18 Claims, 18 Drawing Sheets

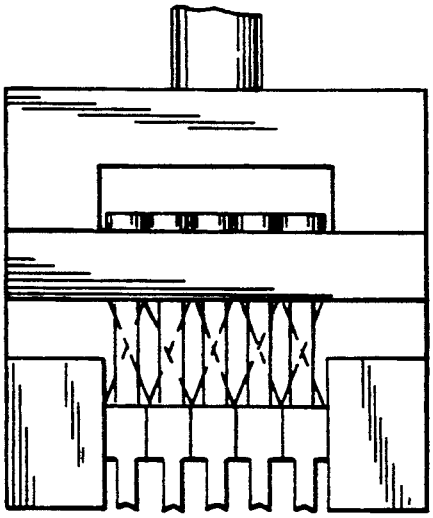
FIG.9
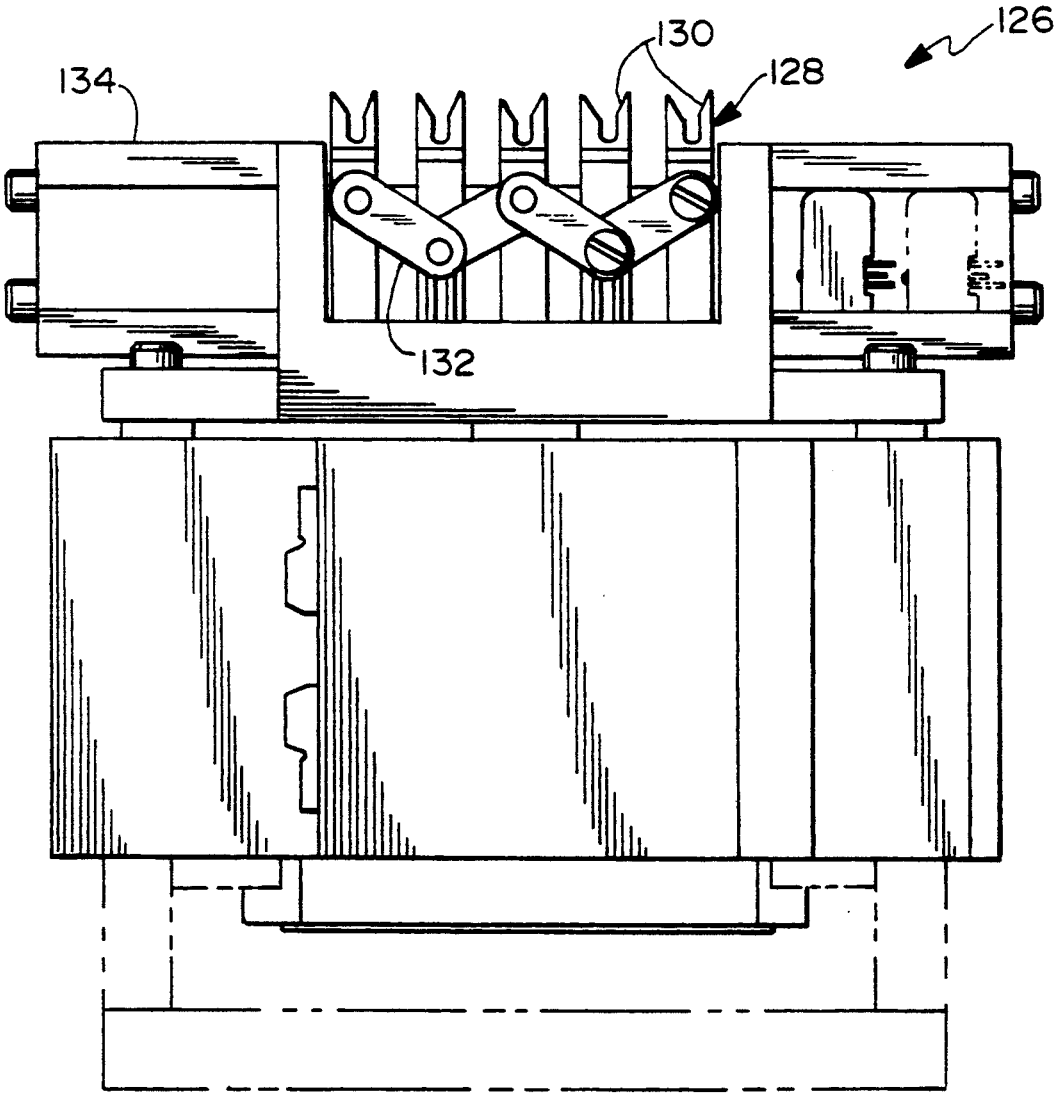

ELECTRICAL HARNESS ASSEMBLY APPARATUS

This application is a continuation-in-part of U.S. patent application Ser. No. 07/392,808 filed on Aug. 10, 1989.

BACKGROUND OF THE INVENTION

Lighting systems for buildings typically are wired in the field by electricians. The electrician typically will run a shielded multi-conductor cable, such as BX cable, from a central panel through conduits that may be mounted in suspended ceilings or walls of a building. The cables that extend from the central panel typically will lead to distribution boxes, from which the electrician will extend a plurality of separate cables to lighting units, switches or the like. The electrician working in the field will strip insulation from the various cable wires and manually complete the electrical connections at the central panel, the distribution boxes and the junction boxes. Although this standard prior art process is effective, it is extremely labor intensive.

Considerable manufacturing efficiencies have been achieved with respect to the stripping of insulation from wires, crimping terminals onto the wires and mounting terminated leads into electrical connector housings. In particular, the prior art includes many variations of apparatuses and processes for making electrical harnesses for signal lines having a plurality of insulated conductors terminated at each respective end, with the terminals thereof mounted in associated housings. The available harness assembling equipment, however, generally is operative to repeatedly perform a plurality of substantially identical operations, with each terminal, each wire and each harness being identical.

Some known harness assembling equipment includes means for adjusting the crimp height to enable the harness assembling equipment to be changed over from making harnesses of a first dimension and/or type to making harnesses of a second dimension or type. Examples of this prior art include U.S. Pat. No. 4,587,725 which issued to Ogawa et al. on May 13, 1986; U.S. Pat. No. 4,790,173 which issued to Boutcher, Jr. on Dec. 13, 1988; U.S. Pat. No. 4,707,913 which issued to Moline on Nov. 24, 1987; and U.S. Pat. No. 4,400,873 which issued to Kindig et al. on Aug. 30, 1983. Each of these references shows apparatus for selectively adjusting the stroke of the crimp press. Another prior art terminating press is shown in U.S. Pat. No. 4,576,032 which issued to Maack et al. on Mar. 18, 1986 and which shows a crimp press having deflectable members to account for certain ranges of variations in the dimensions of a crimped terminal.

The prior art includes power wire harness assemblies that are intended to eliminate a substantial portion of the on-site wiring that typically is completed by electricians in the field. In particular, extremely effective power wire harness assemblies have been provided by Lithonia-Reloc of Conyers, Ga. These assemblies include a shielded cable, such as BX cable, having a plurality of insulated conductors therein and having suitable electrical connectors securely mounted at opposed ends. The Reloc power wire harness assemblies can be extended from one junction box to another, from one cable to another or from a cable or junction box to a lighting fixture. Many power wire harnesses sold by Reloc include drop wires which extend from one of the two cable connectors of the power wire harness. The drop wire, with an associated connector mounted thereto, may be adapted to extend into a knockout on a lighting fixture.

The typical power wire harness assembly manufactured by Lithonia-Reloc will include drop wires extending from the cable connector only at one end of the cable. The cable connector having drop wires extending therefrom will be mated to a cable connector on another harness assembly that has no drop wires. Thus, a daisy chain of power wire harness assemblies may be created, with drop wires extending from one cable connector in each harness assembly, and from one cable connector in each mated pair of cable connectors.

The above described Reloc power wire harness assemblies substantially decrease the amount of on-site labor required by electricians. However, these prior art assemblies have not been well suited for the above referenced prior art automated harness assembling equipment. In particular, the terminations in each power wire harness assembly will vary significantly from one terminal to the next. For example, some terminations will require grounding clips, while others will not. Some terminals will include drop wires, while others will not. The drop wires may be 12 gauge solid or stranded wire, 18 gauge solid wire or 18 gauge stranded wire, with the particular selection of drop wires varying from one harness to the next. In most instances, the terminations at one end of the harness assembly will be significantly different from the terminations at the opposed end. In addition to the differences between the terminations on any single harness assembly, it is necessary to produce many different types of harness assemblies in accordance with the voltage and phasing requirements of the building's electrical system. For example, the gauge and number of conductors in the power cable may vary significantly from one harness assembly to the next. More particularly, the power cables are likely to include anywhere between three and five conductors per cable, with each conductor being either 12 or 18 gauge and being either solid or stranded. The length of the respective cables also will vary significantly from one harness assembly to the next. In view of these variables, the production of power wire harness assemblies has not been automated, and has merely moved the labor intensive assembling work from a largely uncontrolled field location to a more closely controlled factory location.

Attempts to improve the efficiency of the above described power wire harness assembling process is also rendered difficult by the high degree of quality control required for power wiring in buildings. Quality control often can be assured by visually inspecting the harnesses at various stages of their manual assembly. Automated harness assembling devices, however, make visual inspection during the manufacturing process more difficult. In many instances, the terminations produced by the prior art apparatus are substantially hidden from view when the completed harness is ejected from the prior art apparatus.

In view of the above, it is an object of the subject invention to provide an apparatus for more efficiently producing power wire harness assemblies.

It is a further object of the subject invention to provide a power wire harness assembling apparatus that can readily adjust to different termination requirements from one conductor to the next and from one harness assembly to the next.

A further object of the subject invention is to provide an apparatus and process for efficiently completing a power wire harness wherein selected terminals of the assembly have drop wires simultaneously terminated with selected cable wires.

Still another object of the subject invention is to provide a power wire harness assembling apparatus and process which substantially simultaneously checks the presence of terminals and guides the terminals into a housing.

An additional object of the subject invention is to provide a cable fixturing apparatus which places cable wires at a first pitch during trimming, stripping and terminating operations, but which establishes a second pitch for insertion into a housing.

SUMMARY OF THE INVENTION

The subject invention is directed to an apparatus and/or a system of apparatuses operatively connected to one another for assembling power wire harnesses. In particular, the subject invention may comprise conveying means for conveying a multi-conductor cable to a plurality of assembly or work stations at which the various conductors are prepared, terminated and inserted into a housing.

A conveying means of the subject invention may cooperate with pallets on which cables of preselected lengths may be coiled and fixtured. The conveying means may comprise means for selectively indexing the pallets to one or more work stations at which various harness assembling steps may be carried out. The system may include means for selectively permitting idling of the pallets while work is being performed at one or more downstream locations. The system may further include means for selectively disengaging pallets from the conveying means and maintaining disengaged pallets at fixed positions in proximity to one or more work stations of the system. Each pallet of the conveying means preferably comprises a pair of fixtures for rigidly fixturing each end of the cable, such that the respective conductors thereof are in controlled spaced relationship to one another, with the respective ends of the conductors being disposed for selected work to be carried out thereon. The fixtures may be operative to change the spacing between the conductors at selected work stations.

The system of the subject invention may comprise a work station with means for cutting and stripping drop wires to be terminated with selected conductors of the cable. This station may further comprise means for automatically placing the drop wires into selected wire receiving portions of the fixtures on the pallets. The drop wires may be positioned in the fixtures prior to or after placement of the cable wires therein. The order in which the drop wires are placed in the fixtures may be selected to achieve the most efficient flow of pallets through the work stations of the system.

The system may further comprise one or more stations for trimming the cable wires to selected lengths, and/or for stripping selected lengths of insulation from the cable wires. The stripping preferably is carried out by cutting means which cuts through the insulation and subsequently pulls the insulation relative to a fixedly positioned pallet on which the cable wires are fixtured. The positioning of the drop wires relative to the cable wires can be either before or after the trimming and stripping of the cable wires as noted above. However, in embodiments where the drop wires are positioned first, it may be necessary to dispose the stripped end of the drop wire axially rearwardly of the end of the cable wire to prevent interference between the drop wire and the trimming and stripping means for the cable wire. In these latter embodiments, the station for stripping the cable wire may further comprise means for pulling the end of the drop wire axially forwardly and into alignment with the stripped end of the cable wire.

The system of the subject invention may further comprise one or more stations for crimping terminals to the ends of the wires. The crimping station may be in proximity to means for feeding grounding clips to selected terminals in the power wire harness. The crimping station preferably is operative to sequentially crimp terminals to the conductors at each end of the power wire harness assembly. However, the sequential crimping may be carried out simultaneously at both ends of the harness assembly.

The crimping apparatus may comprise programmable means for selectively varying the crimp height for each sequential crimp as needed. In particular, the crimp height will be adjusted depending upon the gauge of wires to be terminated, the presence or absence of a grounding clip and the presence, absence and/or size of a drop wire. The adjustment of the crimp height may be carried out by at least one cam wedge means which may be linearly slidable relative to the crimping press to effectively alter the position of the head of the crimp press for both the conductor and the insulation at the completion of a crimping cycle. The crimp press also may be programmable to control the number of crimping operations carried out at each end of the harness assembly in accordance with the number of conductors that are present at a particular end of the harness assembly. More than one crimping station may be provided to achieve optimum flow of harness assemblies through the system. The crimping station may further comprise means for assessing the quality of the crimped termination for each terminal.

The system of the subject invention may further comprise a station for inserting the terminated wires of the cable into housings. In particular, housings may be sequentially fed into proximity to the fixtured ends of the cables. Means also may be provided for urging the terminated wires into a center-to-center spacing corresponding to the pitch required for the connector. The mounting of the terminals into the housings preferably is carried out with guide means for ensuring that the terminals are urged into the respective housings without potentially damaging contact between the terminals and the housings as part of the insertion process. The guide means may comprise probes that are directed through terminal receiving apertures in the housing and which subsequently engage the terminals. The probes may define either pins for engaging pin receiving terminals on a harness assembly or concave structures for engaging pin terminals, blades or other such male terminal means on the harness. The housing and the terminals may be moved relative to one another after the probes have properly engaged the terminals, to enable the probes to guide the terminals into the housing.

The probes may comprise portions of test assemblies which test for the presence of terminals. The test assembly may be programmable to test for the presence of the specified number of terminals for the particular harness assembly. The absence of a specified terminal will be sensed by the probes and may generate a signal to identify an unacceptable harness assembly.

The completed harness assembly may advance to other stations for mounting shells over the connector housing. These other stations on the system may be employed to test the completed harness assemblies, mount connectors to the drop wires and/or prepare the completed harnesses for shipment or storage.

BRIEF DESCRIPTION OF THE DRAWINGS

FIG. 9 is a front elevational view of an alternate wire gathering assembly at the housing insertion station.

DETAILED DESCRIPTION OF THE PREFERRED EMBODIMENT

Figure 1:
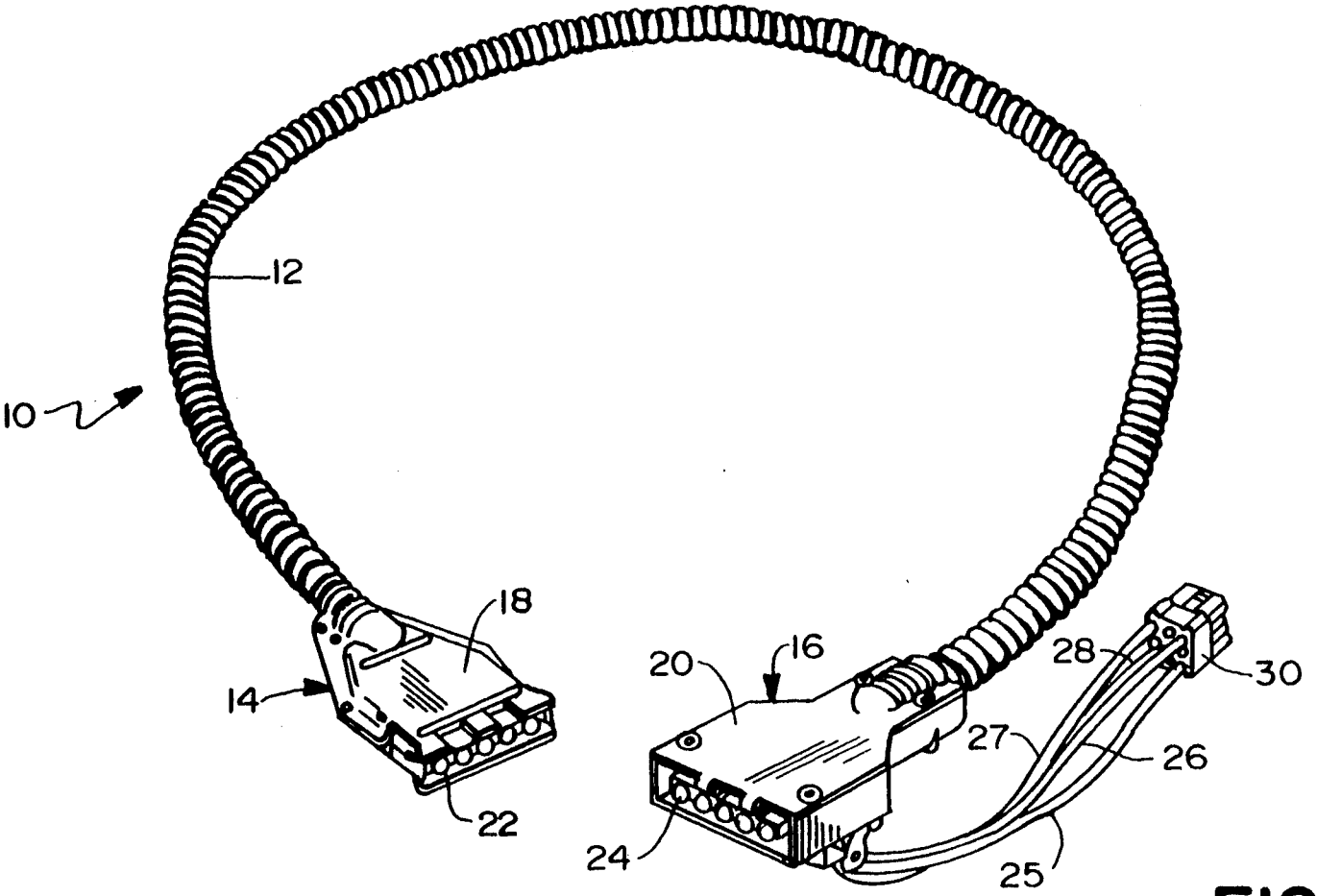
FIG. 1 (PRIOR ART)
FIG. 1 is a perspective view of a prior art power wire harness assembly that is manufacturable by the system of the subject invention.

The system of the subject invention is operative to efficiently produce a prior art power wire harness as indicated generally by the numeral 10 in FIG. 1, which may be one of the harness assemblies of the type manufactured by Lithonia-Reloc. The power wire harness 10 depicted in FIG. 1 is intended for interior applications, such as the fluorescent lighting widely employed in the suspended ceilings of commercial, office or light industrial buildings. It is to be understood, however, that many other applications for the power wire harness 10 exist.

The power wire harness 10 comprises a cable 12, which may define a BX type of cable having a flexible outer metal shield. As depicted in FIG. 1, the cable 12 defines a relatively short length. It is to be understood, however, that the length of the cable 12 is subject to great variation depending upon the specifications established for the end use of the power wire harness 10. The cable 12 of the harness 10 includes a plurality of separately insulated conductors or cable wires (not shown) therein. The number and the cross sectional dimension or gauge of the separate cable wires may vary significantly from one power wire harness 10 to another. For example, the cable 12 may comprise a total of four cable wires therein, which are intended to define two hot wires, one neutral wire and one ground on the completed harness 10. Other cables, however, may have only three cable wires, while others may have five. The particular number of cable wires within the cable 12 will depend upon voltage, phasing and other system parameters.

The power wire harness assembly 10 further comprises connectors 14 and 16 mounted respectively to the opposed ends of the cable 12. The connectors 14 and 16 include electrically conductive terminals (not shown) mounted therein and corresponding in number to the number of cable wires in the cable 12. The connectors 14 and 16 are defined by outer metallic shells 18 and 20 respectively that are mechanically joined to the cable 12. The connectors 14 and 16 further include non-conductive molded housings 22 and 24 respectively in which the terminals (not shown) are mounted.

The connector 16 includes drop wires 25–28 extending therefrom. The drop wires 25–28 are terminated with the cable wires (not shown) to the respective terminals (not shown) within the connector 16. The drop wires 25–28 are terminated to a fixture connector 30 which can be snapped into engagement with a knock-out aperture in a lighting fixture for subsequent pluggable electrical connection to a corresponding connector on a lighting fixture. It will be noted that the connector 14 does not include a corresponding array of drop wires.

A plurality of power wire harnesses 10 of selected lengths may be employed in daisy chain fashion by electrically joining the harnesses 10 in end-to-end relationship. Thus, the connector 14 of one power wire harness 10 will be mated with a connector 16 on a second power wire harness 10. The connections between power wire harnesses will be made in proximity to the knock-out apertures in the lighting fixtures, such that the drop wires 25–28 can be directed toward the lighting fixture. The fixture connector 30 then can be snapped into engagement with the knock-out aperture in the lighting fixture.

It is to be understood that many of the power wire harnesses manufactured by the system and process of the subject invention will be similar to the harness 10 shown in FIG. 1, but will not include the drop wires 25–28. These harnesses will be used substantially like extension cords, and will minimize inventory problems of the specifically configured harnesses 10 having drop wires 25–28 28 extending therefrom. It also should be emphasized that the harnesses 10 are subject to many other variations as noted above. In particular, the specifications of the drop wires may vary considerably as to the number of wires, the gauge of the wires, and whether the wires are stranded or solid. The number and gauges of cable wires also can vary. Additionally, certain of the cable wires will be terminated with grounding clips, while others will not.

Figure 2:
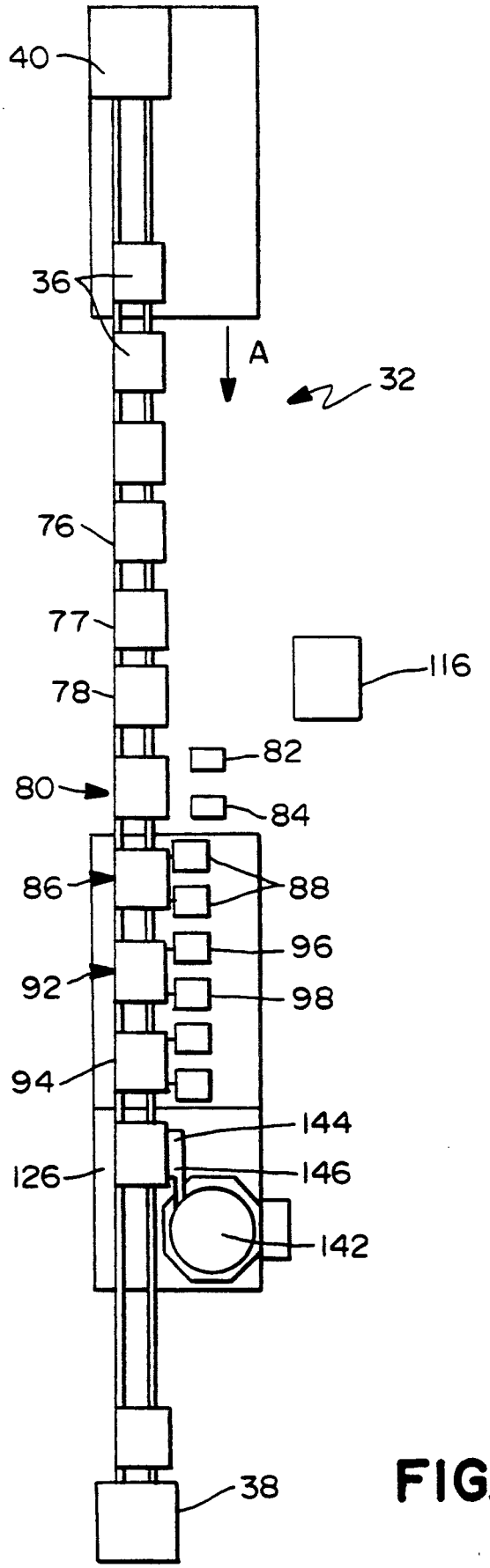
FIG. 2 is a schematic view of the system of the subject invention.

The system for forming the power wire harnesses 10 is illustrated schematically in FIG. 2, and is identified generally by the numeral 32. The system 32 includes a chain track 34 along which pallets 36 are movable. The portion of the chain track 34 illustrated in FIG. 2 is operative to move the pallets 36 linearly in a direction indicated by arrow "A". The system 32 further comprises a down elevator 38 and an up elevator 40 which define the extreme ends of the system 32. The system 32 further comprises a lower chain track (not shown) which also connects the down elevator 38 and the up elevator 40 but which is operative to travel in a direction opposite the direction indicated by arrow "A". It is to be understood, however, that the system 32 may define a loop disposed at a single elevation and without the elevators 38 and 40.

Figure 3:
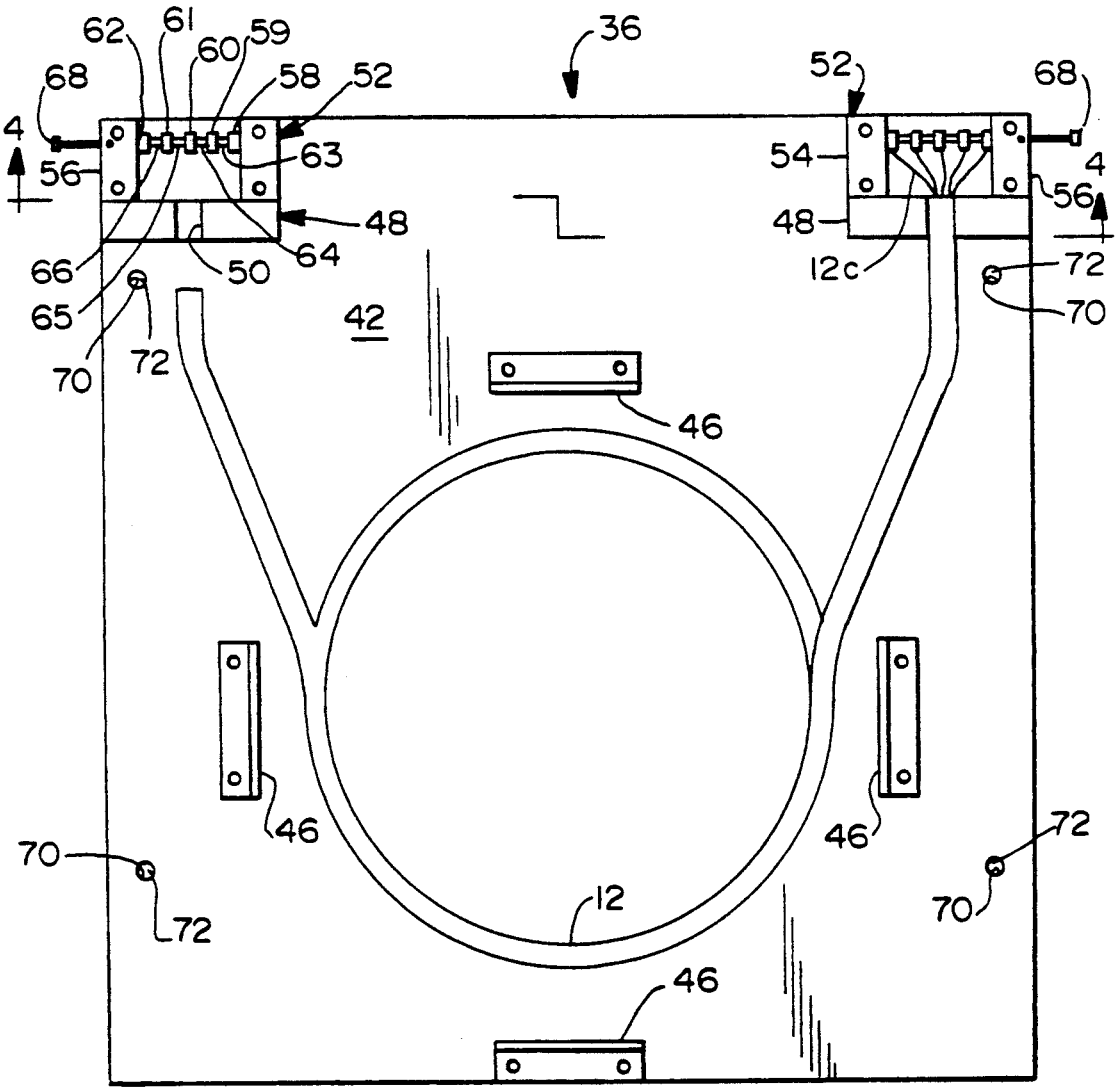
FIG. 3 is a top plan view of a pallet for use in the system of the subject invention.
Figure 4:
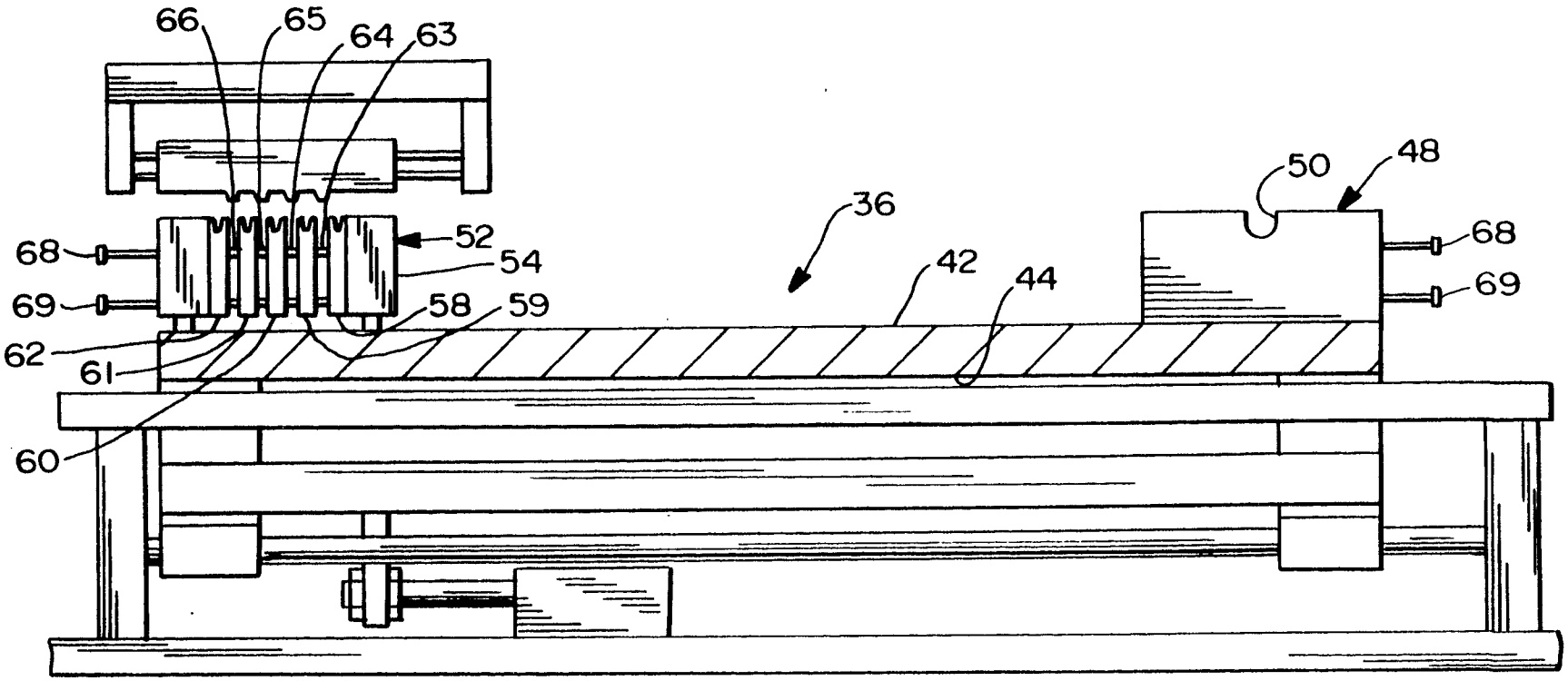
FIG. 4 is a front elevational view of a pallet in proximity to a crimper of the subject system.

A pallet 36 is illustrated in greater detail in FIGS. 3 and 4. More particularly, the pallet 36 is a generally rectangular planar structure having a top surface 42 and an opposed bottom surface 44. The top surface 42 of the pallet 36 includes a plurality of cable guides 46 rigidly mounted thereto in spaced relationship to one another. The cable guides 46 enable a coil of cable 12 to be securely retained on the pallet 36, as shown in FIG. 3.

The pallet 36 further comprises a pair of cable support brackets 48 having generally semi-cylindrical grooves 50 formed therein for receiving portions of the cable 12 adjacent the ends of the metallic shield thereon. The cable support brackets may optionally be provided with clamping means for securely, but releasably, retaining the cables therein.

Wire holder assemblies 52 are mounted to the top surface 42 of the pallet 36 adjacent the cable support brackets 48. This particular embodiment of each wire holder assembly 52 comprises a pair of end supports 54 and 56 which are mounted to the top surface 42 of the pallet 36 in spaced relationship to one another. A plurality of wire guides 58–62 are disposed intermediate the supports 54 and 56 respectively. The wire guides 58–62 each include a notch in the top portion thereof dimensioned to engage one of the cable wires and to additionally engage one of the drop wires if required. The wire guide 58 is rigidly mounted to the end support 54. However, spring assemblies 63–66 are sequentially disposed intermediate adjacent wire guides 58–62 as shown in FIG. 3. Thus, the wire guides 59–62 can be collapsed relative to one another and urged respectively toward the wire guide 58. However, the forces exerted by the springs 63–66 will urge the wire guides into a fully extended position relative to one another such that the wire guide 62 is adjacent to the support 56.

The wire holder assembly 52 further comprises core pins 68 and 69 which extend slidably through the support 56 and are attached to the wire guide 62. Thus, a force exerted on the core pins 68 and 69 will overcome the forces exerted by springs 63–66 and cause the wire guides 59–62 to be urged toward one another and toward the wire guide 58. In their extended condition, as shown in FIG. 3, the wire guides 58–62 define center to center spacings of approximately 0.588 inch. However, in their collapsed condition the wire guides 58–62 define center to center spacings of only about 0.316 inch which corresponds to the pitch of the housing as explained below. Other selected center to center spacings in the expanded and collapsed conditions of the wire holder assembly 52 may, of course, be provided depending upon the requirements of the system. The object of the selective expansion and contraction of the wire holder assembly is to provide adequate room for trimming, stripping and crimping operations in the expanded condition, and also to enable efficient insertion of the terminated wires into closely spaced apertures in a housing.

Another efficient but substantially less expensive alternative to the above described wire hold assemblies 52 is to replace wire holder assemblies 52 with a rigid wire holder assembly generally designated 200 (FIG. 16) with wire guide receiving slots 201 disposed at a center-to-center spacing of 0.588 inch, or other appropriate spacing for the terminals being employed. Wire holder 200 includes a two piece block assembly 202 and 203 with springs 204 secured therebetween. Block 202 has vertical apertures 205 therethrough to permit block 202 to slide on bolts 206. In the embodiment shown, wire retainer 207 has five wire receiving slots 201 spaced 0.588 inches apart. Wire retainer 207 is made of polyurethane to permit wires **12*c* and 12*d* to be releasably held in each slot 201**. As discussed below, an appropriate downstream station may then be provided to remove wires from the wire guides and to collapse the wires to a closer spacing for insertion into a housing as explained and illustrated below.

The pallet 36 further includes a plurality of shot pin holes 70 which are engageable by shot pins 72 to lift the pallet 36 from the chain track 34 at selected work stations as shown in FIG. 3, and as explained further below.

Returning to FIG. 2, the pallets 36 of the system 32 are movable along the chain track 34 to a plurality of different work stations. The first station is a cable load station 76. A technician may be disposed at location 76 to manually load coils of cable 12 onto the pallet 36 positioned at station 76. The cable 12 typically will be coiled to define a diameter of approximately 15 inches with lengths of cable extending between 2 inches and 12 inches beyond the tangent point of the coil. The cable 12 will be pre-cut to a selected length and will have selected lengths of cable wires extending from the respective opposed ends of the shielding.

Stations 77 and 78 are located downstream of the cable load station 76 and define stations for fixturing the cable wires within the wire holder assemblies 52. The stations 77 and 78 may be operated by one or more technicians depending upon the cycle times required for the system 32. For example, station 77 may be employed to position and fixture the cable wires at the first end of the cable 12, while station 78 may be employed to position and fixture wires at the opposed second end of the cable 12. The cable wires are mounted in the wire holder assemblies 52 in an unstripped condition. Additionally, in some operations, drop wires may be positioned manually in the fixtures immediately prior to the manual placement of the cable wires. Any drop wires that may be positioned at this station will be stripped and may have terminals attached to the trailing end. The drop wires will be positioned in the fixtures first and the cable wires will then be positioned with their unstripped ends axially forwardly relative to the ends of the precisely positioned drop wires. It should be noted that most drop wires will be automatically positioned at a downstream station as explained herein. Manual placement of drop wires will only be employed to achieve optimum cycle time in some situations.

A trim and strip station 80 is disposed downstream from the cable wire fixturing stations 77 and 78. The trim and strip station 80 is initially operative to simultaneously trim the cable wires to specified lengths, such that the trimmed ends of the cable wires are at specified distances forward of the fixtures and the ends of any previously positioned drop wires. The station 80 subsequently is operative to strip a selected amount of insulation from each cable wire. As shown in FIG. 2, the trim and strip station 80 includes first and second trimming and stripping devices 82 and 84 for the respective first and second ends of each cable 12. The trimming and stripping devices 82 and 84 are operative to simultaneously cut all wires on a pallet 36 and then to simultaneously strip all wires on the opposed first and second ends of the cable 12. Such trimming and stripping devices are well known in the art. One manufacturer of such devices is Komax AG, Lucerne, Switzerland. The trimming and stripping devices 82 and 84 are operative to move relative to the pallet 36 for pulling the insulation from the conductor of each cable wire 12. This pulling movement of the trimming and stripping devices 82 and 84 also is operative to grip any drop wire that may be present and pull it forwardly to be aligned with the trimmed end of the cable wire.

The drop wire station 86 is operative to programmably pay-out specified lengths of a selected drop wire, which may be 12 gauge solid wire, 18 gauge solid wire or 18 gauge stranded wire. The leading end of the length of drop wire is appropriately stripped and is programmably placed in a selected wire guide 58–62 of the wire holder assembly 52. The opposed end of each drop wire may be stripped, partially stripped or unstripped depending upon the particular connection to be made with the drop wires. As noted above, not all harness assemblies produced by the system 32 will require drop wires. In situations where drop wires are not required, the station 86 will merely define a test station.

Figure 5:
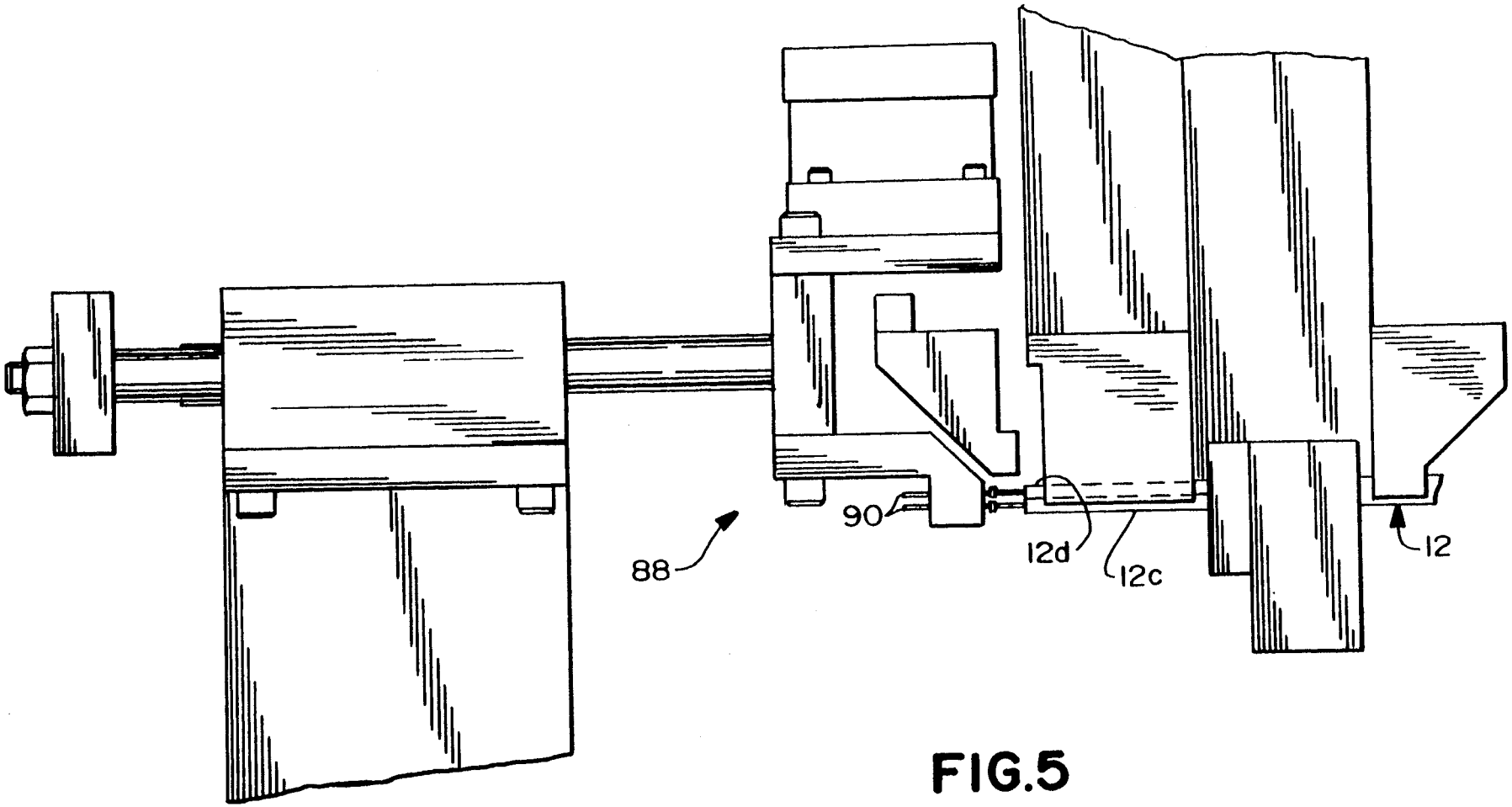
FIG. 5 is a side elevational view of the wire continuity and position sensor assembly of the subject system.
Figure 6:
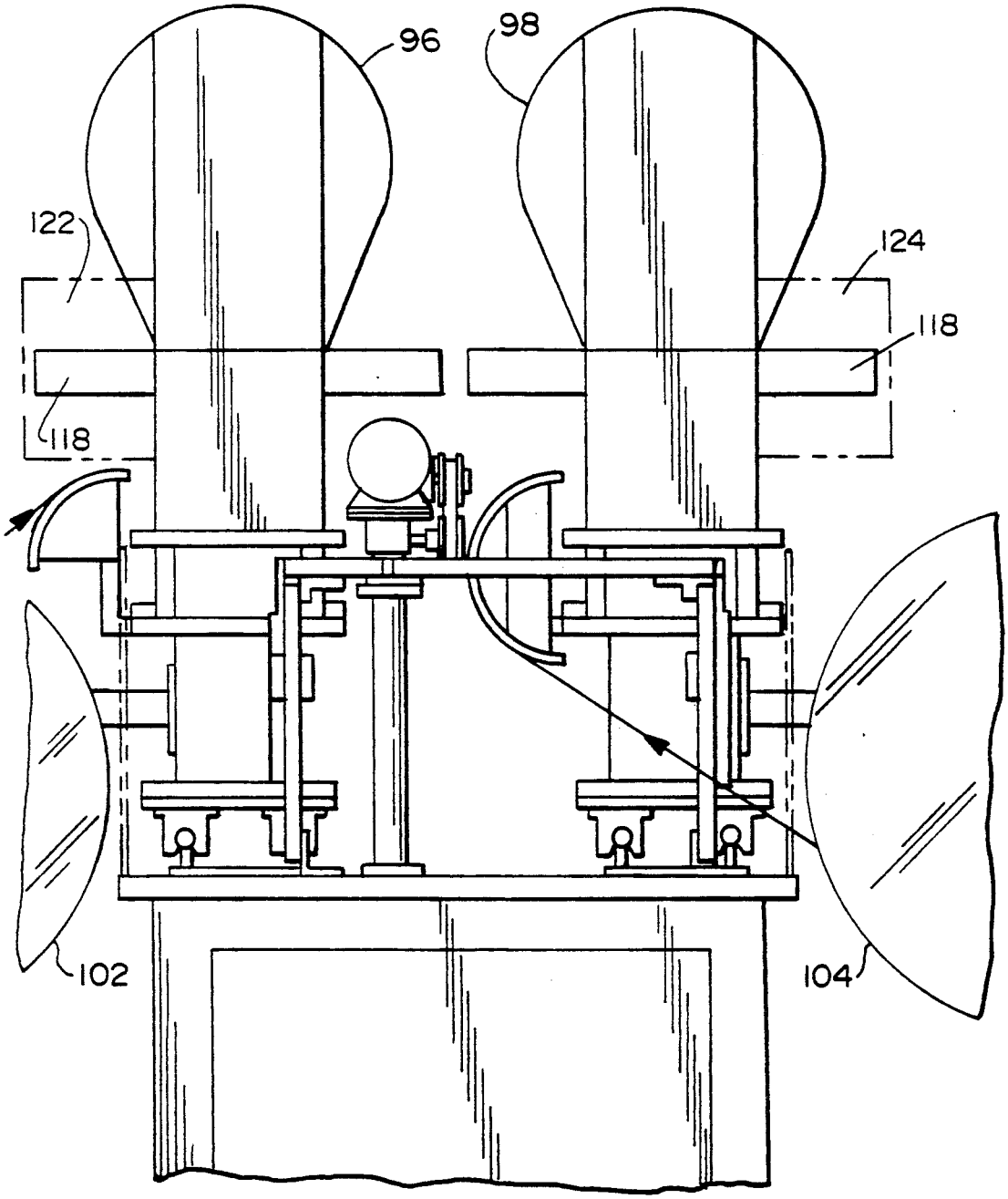
FIG. 6 is a front elevational view of the crimp station of the subject system.

The drop wire station 86 (FIG. 5) includes testers 88 as shown in FIG. 5. Each tester 88 includes probes 90 which are disposed to be axially in line with any cable wires 12*c* or drop wires 12*d* that may be present. The probes 90 are operative to move axially forward to contact the ends of the conductors that may be present, and to test for the presence of each conductor that should be present, to test for proper position of the conductor and to test for continuity between opposed ends of each cable wire 12*c*. A failure of any test will generate a signal to identify the particular pallet for a special treatment which may vary depending upon the particular sensed condition. In some instances, the cable 12 will have to be scrapped, while in other instances appropriate corrective action may be employed, such as realigning the stripped end of a wire or positioning a drop wire.

Figure 17:
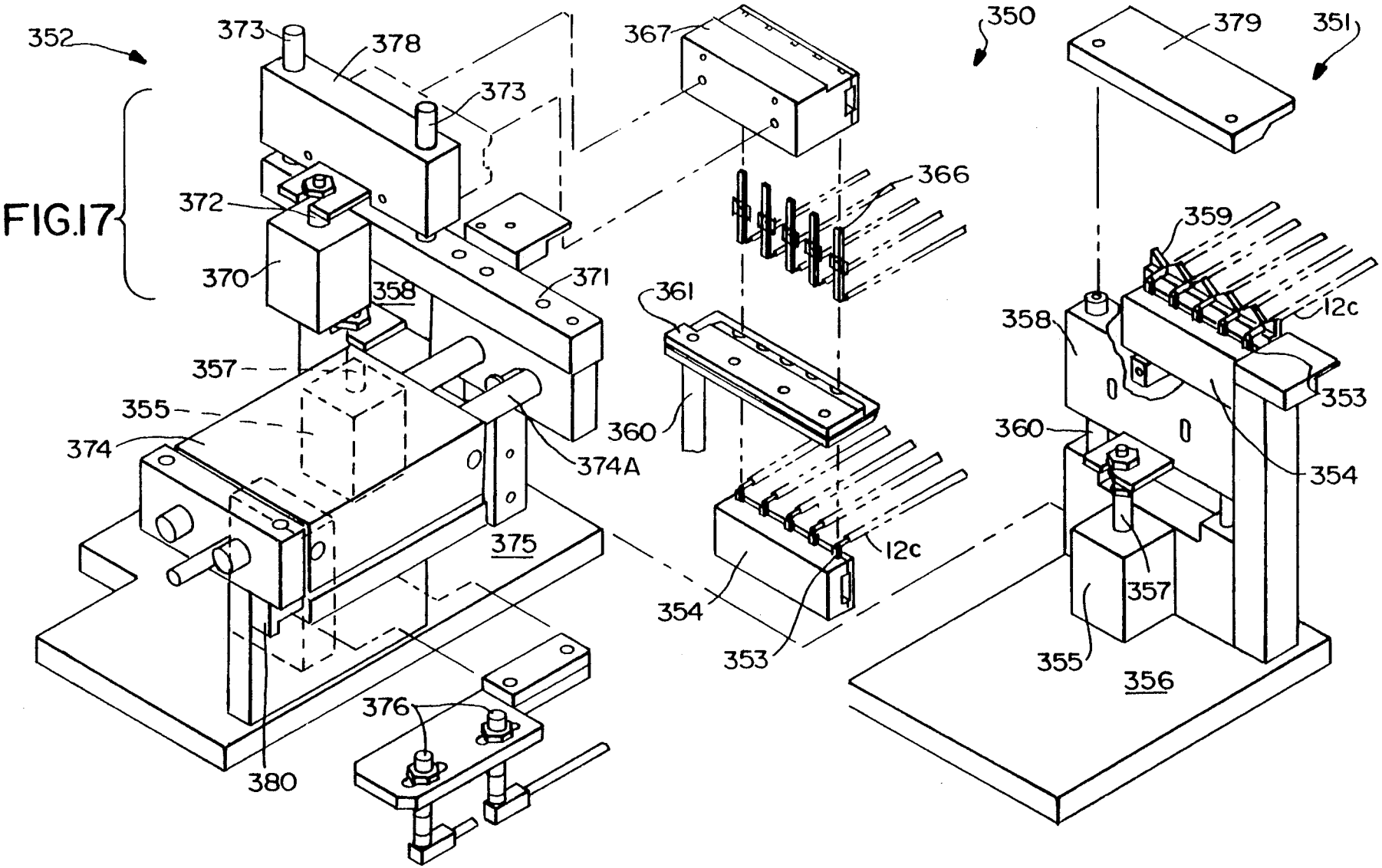
FIG. 17 is an exploded perspective view of an alternative wire continuity and position sensor assembly.

An alternative testing station indicated generally at 350 is shown in FIG. 17. Testing station 350 has two substations 351 and 352, one for each end of cable 12. The first substation 351 is utilized for testing the end of cable 12 having only cable wires 12*c*. The second substation 352 is utilized for testing the end of cable 12 having both cable wires 12*c* and drop wires 12*d*.

Substation 351 has five spring-loaded test probes 353 reciprocally mounted in lower contact holder 354 and oriented perpendicular to wires 12*c*. The test probes 353 project out of holder 354 a sufficient distance to permit contact with the conductor of stripped wires 12*c*. Electrical wires (not shown) are attached in known manner to the system controller. Pneumatic cylinder 355 is fixed to frame 356 and cylinder rod 357 is secured to block 358 which is secured to holder 354. When cylinder 355 is actuated, block 358 is forced upward and slides along guide rods 360 which extend therethrough. Tapered wire guides 359 are provided to guide wires 12*c* to probes 353.

Figure 23:
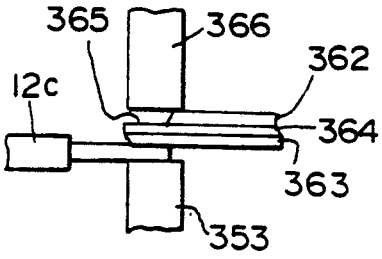
FIG. 23 is a detail side elevational view of a portion of the wire separator of FIG. 22.

The second substation 352 includes the same structure as that of the first substation 351 and like numbers are used to describe like components. The second substation further comprises a wire separator 361 that is fixed to the top of guide rods 360. Wire separator 361 includes two outer insulating members 362 and 363 with a conductive plate 364 disposed therebetween. A wire (not shown) is attached to conductive plate 364 and extends to the system controller. Upper insulating member 362 is dimensioned so that a portion 365 of the upper surface of conductive plate 364 is exposed so that the stripped portion of drop wires 12*d* can contact portion 365 (FIG. 23). However, the portion 365 is sufficiently narrow so that a drop test wire probe 366 (described below) will contact the upper non-conductive member 362 rather than conductive plate 364 upon moving probes 366 towards wire separator 361.

Drop wire test probes 366 are spring-loaded and mounted for reciprocal vertical movement in upper contact holder 367 in the same manner as probes 353 and also include electrical wiring to the system controller. Pneumatic cylinder 370 is secured to offset bar 371 and the cylinder rod 372 is fixed to block 378. Retracting cylinder 370 pulls block 378 downward and slides it along guide rods 373 which extend therethrough. Upper contact holder 367 is fixed to block 372. Offset bar 371 is fixed to shafts 374A which are driven by powerslide 375 that is fixed to frame 376. Proximity sensors 377 are connected to the system controller in known manner and are associated with proximity flag 380 so that the controller can confirm that the powerslide 375 has completed a stroke.

In operation, a pallet 36 arrives at testing station 350 with wires 12*c* stripped and held in wire holder 200. The pallet is aligned so that wires 12*c* at each end of the harness 10 are located above probes 353 at the first and second substations 351 and 352. The wires 12*c* associated with substation 352 are located below wire separator 361 and the wires 12*c* associated with substation 351 are located beneath plate 379.

Drop wires 12*d* having stripped ends are then inserted into the wire holder at substation 352 so that the stripped ends are located above wires separator 361. Power slide 374 is then actuated to slide offset bar 371 and the test probes 366 mounted thereon horizontally towards the drop wires until the test probes are located above the drop wires 12*d* and wire separator 361. Pneumatic cylinders 355 are then actuated to force probes 353 into contact with cable wires 12*c*. Pneumatic cylinder 370 is retracted which forces upper contact holder 367 downward. The drop wire test probes contact any drop wires that are located at substation 352. If no drop wire is present, the probe will contact upper insulating member 362. If a drop wire is present and is properly stripped, the probe associated with that drop wire will complete an electrical circuit between the conductive plate 364 and probe 366.

The system controller will then test the wires to verify that each wire 12*c* at both ends of the cable 12 are in the correct position within wire holder 200. That is, the controller will determine whether the wires have been loaded into the wire holder in the incorrect sequence. If the controller does not sense the continuity between the ends of the wires, an error signal is generated. Likewise, if a drop wire is supposed to be present, probe 366 must complete the circuit to conductive plate 364 or else an error signal will be generated.

Crimp stations 92 and 94 are disposed downstream from the drop wire station 86. The provision of two crimping stations 92 and 94 is intended to provide the most efficient cycle time and to avoid down time for maintenance. The crimp stations 92 and 94 are otherwise identical, except for the particular cable wires and terminals being crimped, and each is operative to crimp as many as five wires. Thus one crimp station 92 or 94 may be used for all crimps when the other station is down for repair or tool replacement.

The crimp station 92 as shown in FIG. 2 and 6–8 includes first and second crimping presses 96 and 98 and a ground clip feed bowl 100 which is operative to feed ground clips (not shown) to the wire guides prior to crimping. The first and second crimp press 96 and 98 each are operative to sequentially crimp terminals fed from reels 102 and 104 to both the conductor and insulator of wires 12*c*, 12*d* at the respective first and second ends of the cable 12. The pallet 36 disposed at the crimp station 92 is indexed incrementally between sequential cycles of the crimp presses 96 and 98 by the servo feed shown schematically in FIG. 7 and identified generally by the numeral 106 in FIG. 7. Thus, the crimp presses 96 and 98 will simultaneously crimp a terminal to a first cable wire 12*c* plus any drop wire 12*d* or ground clip that may be present in the cable 12. The pallet 36 will then index approximately 0.588 inch and the first and second crimp presses 96 and 98 will crimp terminals to second cable wires in the cable 12 plus any drop wire or ground clip that may be present. This cycle will repeat at least a third time after which the pallet 36 may be advanced to a downstream station for either additional terminal crimping operations or for insertion of the terminated wires into the housing as explained below. Thus, crimp press 96 will crimp all of the terminals at one end of cable 12 and crimp press 98 will crimp all of the terminals at the other end.

Figure 7:
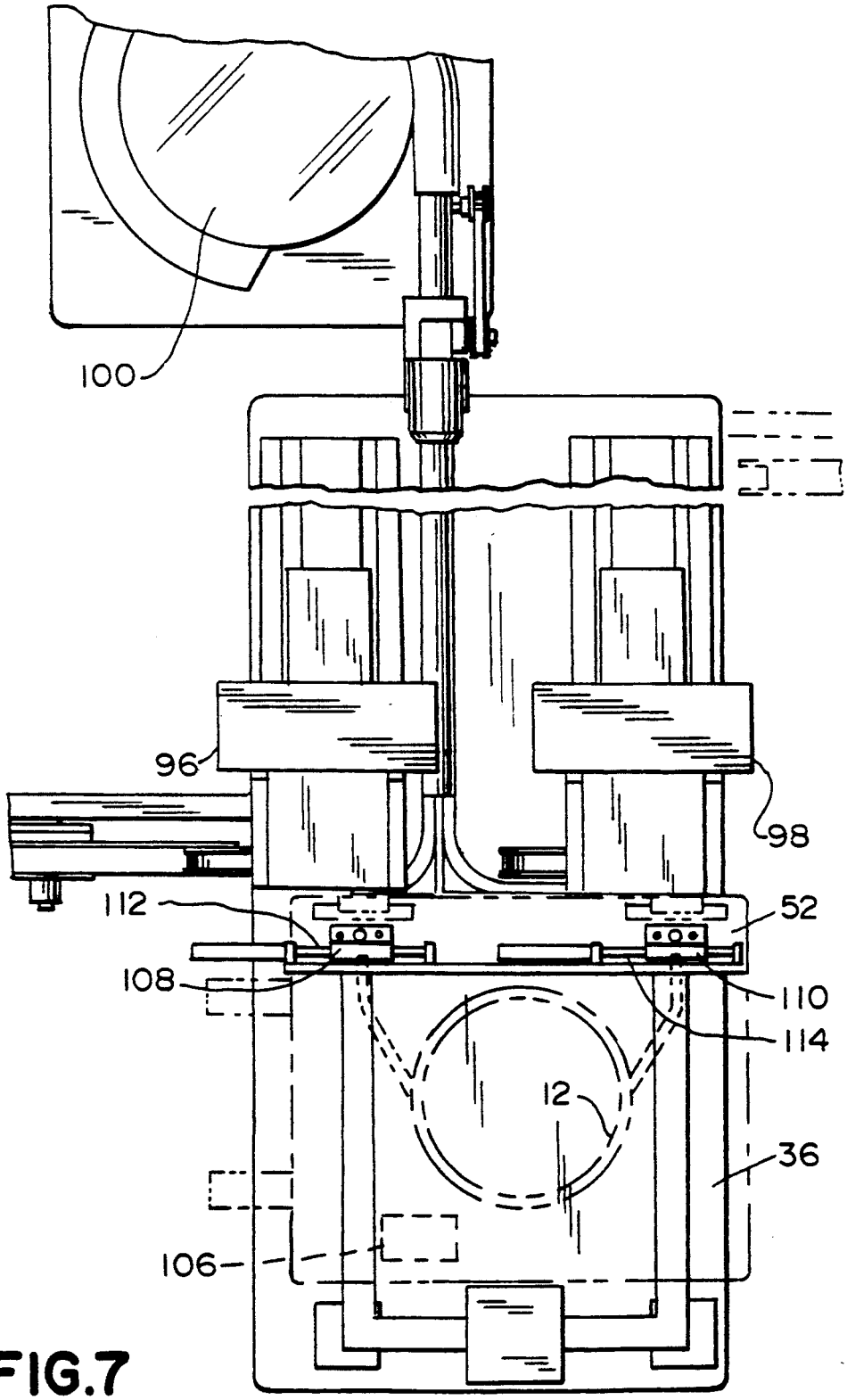
FIG. 7 is a top plan view of a pallet at the crimp station.
Figure 8:
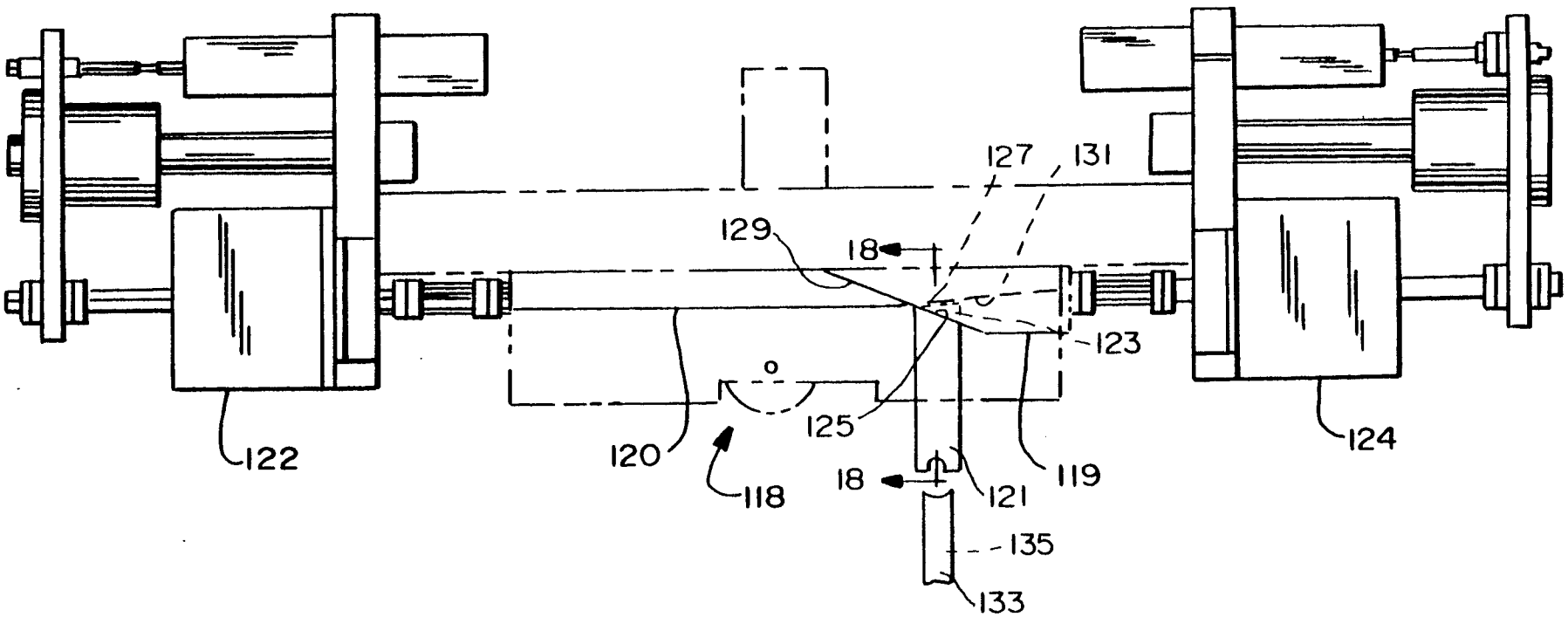
FIG. 8 is a front elevational view of the crimp adjustment apparatus.

The crimping presses 96 and 98 comprise wire locators 108 and 110 respectively which are slidably mounted on support rods 112 and 114 as shown in FIG. 7. The wire guide locators 108 and 110 are urged downwardly as part of an initial movement of the crimp press 96, 98 to securely retain the wires and ground clips in the wire guides 58–62. The wire guide locators 108 and 110 will slide along the rods 112 and 114 with the indexing of the pallet 36 by servo motor 106 between sequential cycles of the crimp presses 96 and 98.

As noted above, the terminations will vary significantly from one terminal to the next, depending upon the gauge and type of cable wire 12*c*, the gauge and type of any drop wire 12*d* that may be present, and the presence or absence of grounding clips. The terminals 156, however, are the same regardless of which wires are present. The system of the subject invention includes a programmable controller, indicated schematically by the numeral 116 in FIG. 2, into which control data as to the number and gauges of cable wires 12*c*, the presence, absence, type and location of drop wires 12*d* and the location of grounding clips may be entered.

In order to achieve the optimum crimp for each terminal 156 as the pallet is indexed at crimp station 92, the travel of the crimp tooling must vary for each crimp depending upon the absence or presence of the various wires. Accordingly, the crimping presses 96 and 98 comprise crimp height controllers 118 as shown most clearly in FIG. 8, which are operatively connected to the programmable controller 116 in which the control data are entered. In this manner, the crimp presses 96 and 98 are operative to perform an optimum crimp on the particular arrangement of wires and grounding clips being presented thereto. More particularly, the crimp height controllers 118 each comprise cam wedges 119 and 120 which are slidably movable in opposed respective linear directions orthogonal to the crimping direction of the crimp presses and under the action of stepper motors 124 and 122, respectively.

Figure 18:
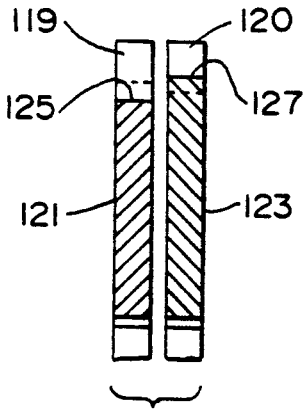
FIG. 18 is a vertical sectional view, on enlarged scale, taken substantially on line 18—18 of FIG. 8.

Conductor crimping punch 121 and insulation crimping punch 123 (FIGS. 8 and 18) are mounted adjacent each other above terminal 156. The punches are slidable vertically and have tapered top surfaces 125 and 127 which contact wedge surfaces 129 and 131 of cam wedges 119 and 120, respectively. Accordingly, by sliding cam wedges 119 and 120 horizontally, the height of punches 121 and 123 above their respective anvils, 133 and 135, and thus the crimp height can be varied.

The controlled sliding movement of the cam wedges 118 and 120 determine the maximum crimp stroke enabled by the crimp press for the conductor crimp and insulation crimp respectively. Thus, the crimp height controller is operative to achieve an optimum crimp height and pull out force for each particular crimp, depending upon the programmed characteristics of the wires and/or grounding clips being terminated.

Figure 10:
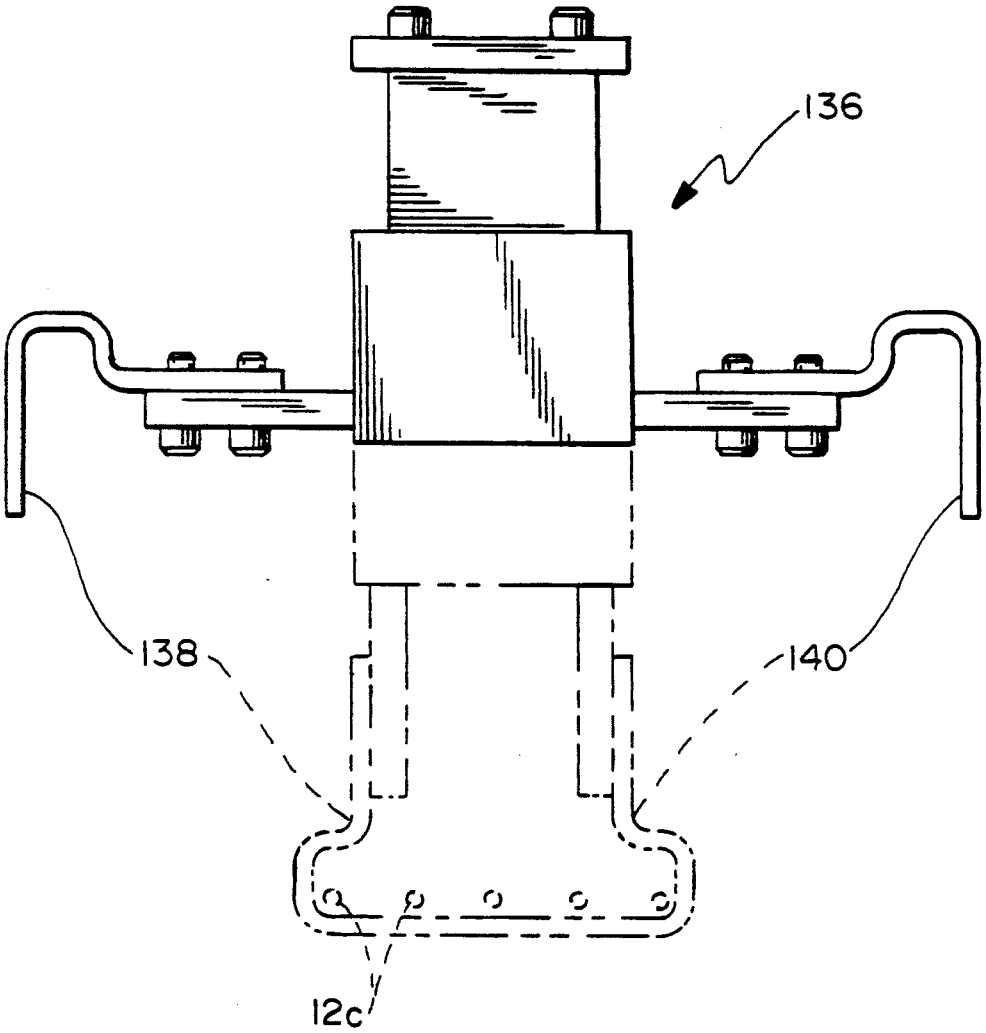
FIG. 10 is a front elevational view of a wire lifter assembly for use with the wire gathering assembly.

After the termination has been completed, the pallet 36 advances downstream to the insertion station 126 as shown in FIG. 2. The movement of the pallet 36 into the insertion station 126 causes the core pins 68, 69 of the wire holder assemblies 52 to be engaged, and thereby collapsing the wire guides 58–62 toward one another. Alternatively, a pallet without collapsible wire holder assemblies may be provided. In this embodiment, as shown in FIG. 9, the insertion station 126 includes a collapsible fixture assembly 128 with separate notched fixtures 130 for engaging the terminated wires. The notched fixtures 130 are connected by pantograph linkage members 132 and are powered by air cylinder 134 to selectively collapse the wires to a 0.316 inch spacing. The insertion station 126 further includes a wire gripper and lifter assembly 136, as shown in FIG. 10, with selectively rotatable arms 138 and 140 for lifting and gathering the wires 12*c* into a spacing consistent with the collapsed condition of the fixture assembly 128. The collapsible fixture assembly 128 and the wire gripper and lifter assembly 136 are operative to lift the ends of the cable 12 from the fixture on the pallet and then to effect the collapsing.

Figure 11:
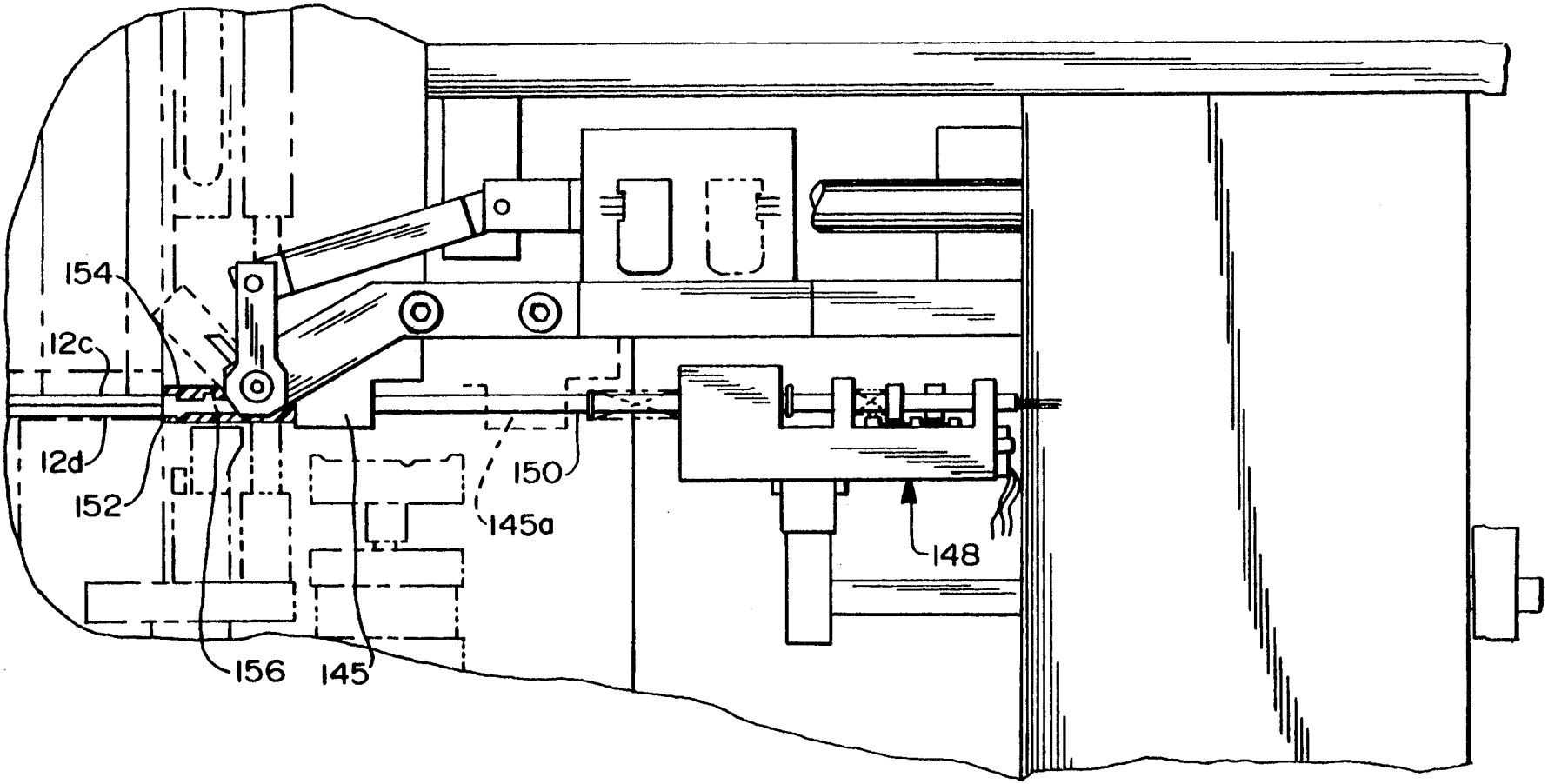
FIG. 11 is a side elevational view of the housing insertion station.

The insertion station 126 includes a dual track bowl feed and supply hopper 142, as shown generally in FIG. 2, from which molded plastic housings are fed into first and second positions 144 and 146 adjacent the opposed first and second ends of the cable 12. The first and second positions 144 and 146 of the insertion station 126 are in proximity to movable probe assemblies 148 as shown in FIG. 11, which have a plurality of probes 150 corresponding in number to the maximum number of cable wires 12c. Additionally, the spacing between the probes corresponding to the spacing between terminal receiving apertures 152 in the housings 154. The probe assemblies 148 advance toward the housing 154 such that the respective probes 150 pass through the corresponding terminal receiving apertures 152 in the housings 154. Additionally, the movement of the probe assemblies 148 causes the respective probes 150 to contact and engage the terminals 156 crimped to the ends of the respective wires 12c, 12d.

The probes 150 are operatively connected to known test circuitry such that the presence of a terminal 156 can be sensed and, if desired, such that the continuity of a cable wire 12c can be sensed. A cable 12 will be identified for rejection if a required terminal is not sensed as being present, or if the probe assemblies 148 fail to accurately sense the necessary continuity along the length of the cable wires 12c. On the other hand, once the probe assemblies 148 have sensed an acceptable product, the insertion station 126 is operative to move the housings 154 relative to the terminals 156 and the probe assemblies 148. The probe assemblies 148 are thus operative to guide the respective terminals 156 into the terminal receiving cavities 152 of the housing 154, while simultaneously ensuring that inadvertent and potentially damaging contact between the leading ends of the terminals 156 and the walls of the housing 154 is avoided. Upon complete movement of the housings 154 over the terminals 156, the probe assemblies 148 are retracted and the pallet 36 is advanced to an unload station at which the completed harness assembly is unloaded. The pallet 36 is then advanced toward the down elevator for recycling in the system. In optional embodiments (not shown), the pallet 36 may advance to locations at which a metallic shell is mechanically engaged around the housing and the jacket of the cable.

Figure 12:
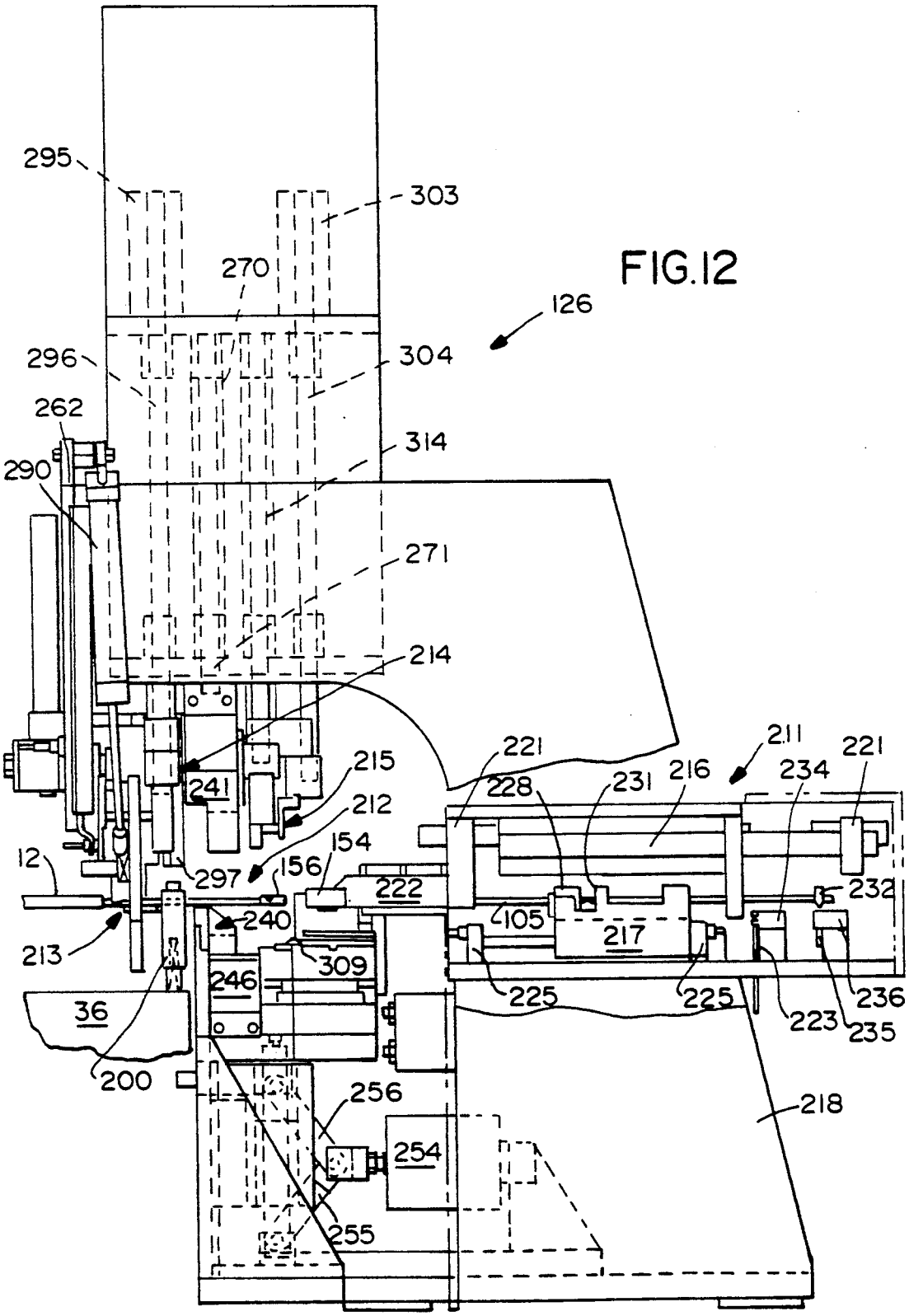
FIG. 12 is a side elevational view of an alternative embodiment of the housing insertion station.
Figure 16:
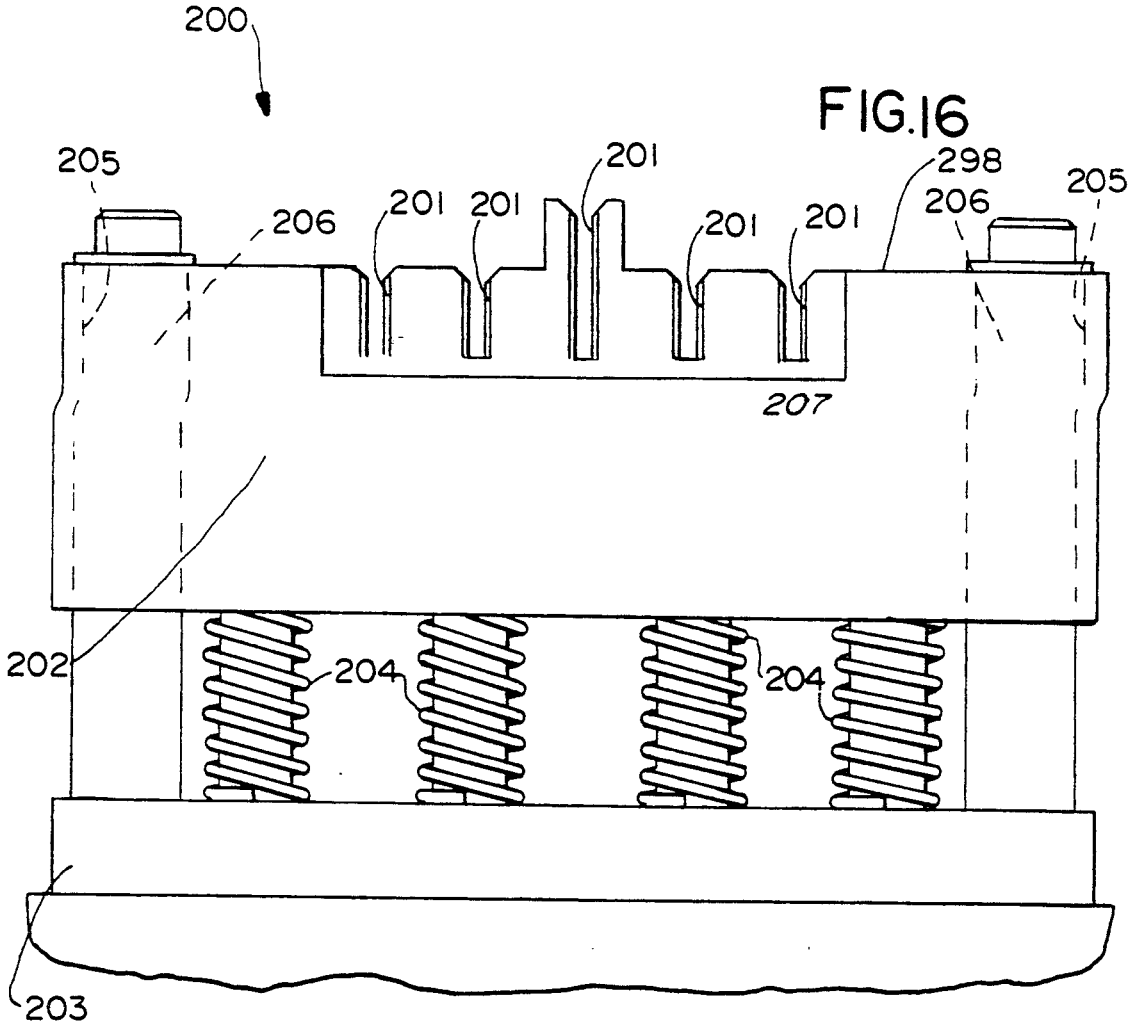
FIG. 16 is a front elevational view of an alternative embodiment of a wire holder mounted on a pallet.
Figure 22:
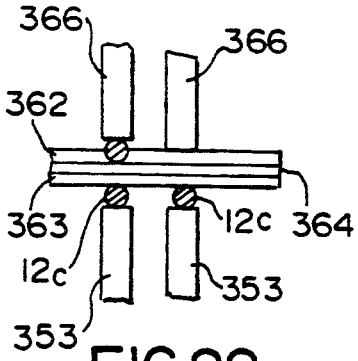
FIG. 22 is a detail front elevational view of a portion of the wire separator of FIG. 17.

An alternative insertion station 126 is shown in FIG. 12. Such an insertion station is utilized with a pallet 36 having a constant pitch wire holder 200 (FIG. 16). The insertion station 126 includes a housing push subassembly indicated generally at 211 for pushing connector housing 154 onto terminals 156. A pitch adjustment subassembly indicated generally at 212 is provided for securing the wires 12c and 12d and reducing the pitch of the cable wires 12c prior to insertion into housing 154. A wire holding subassembly indicated generally at 213 and a subassembly 214 for depressing the wire holder 200 attached to the pallet are also provided. A terminal positioning subassembly indicated generally at 215 for accurately positioning the terminals 156 prior to insertion into housing 154 is further provided.

As previously described, cable 12 has two ends onto which a housing is inserted. Accordingly, as described above, the insertion station 126 includes first and second positions 144 and 146 (FIG. 2) at which the housings 154 are inserted onto the terminals 156. Therefore, it should be understood that only one half of insertion station 126 is described below since each of the mechanisms is required at the first and second positions 144 and 146 of the insertion station.

Figure 13:
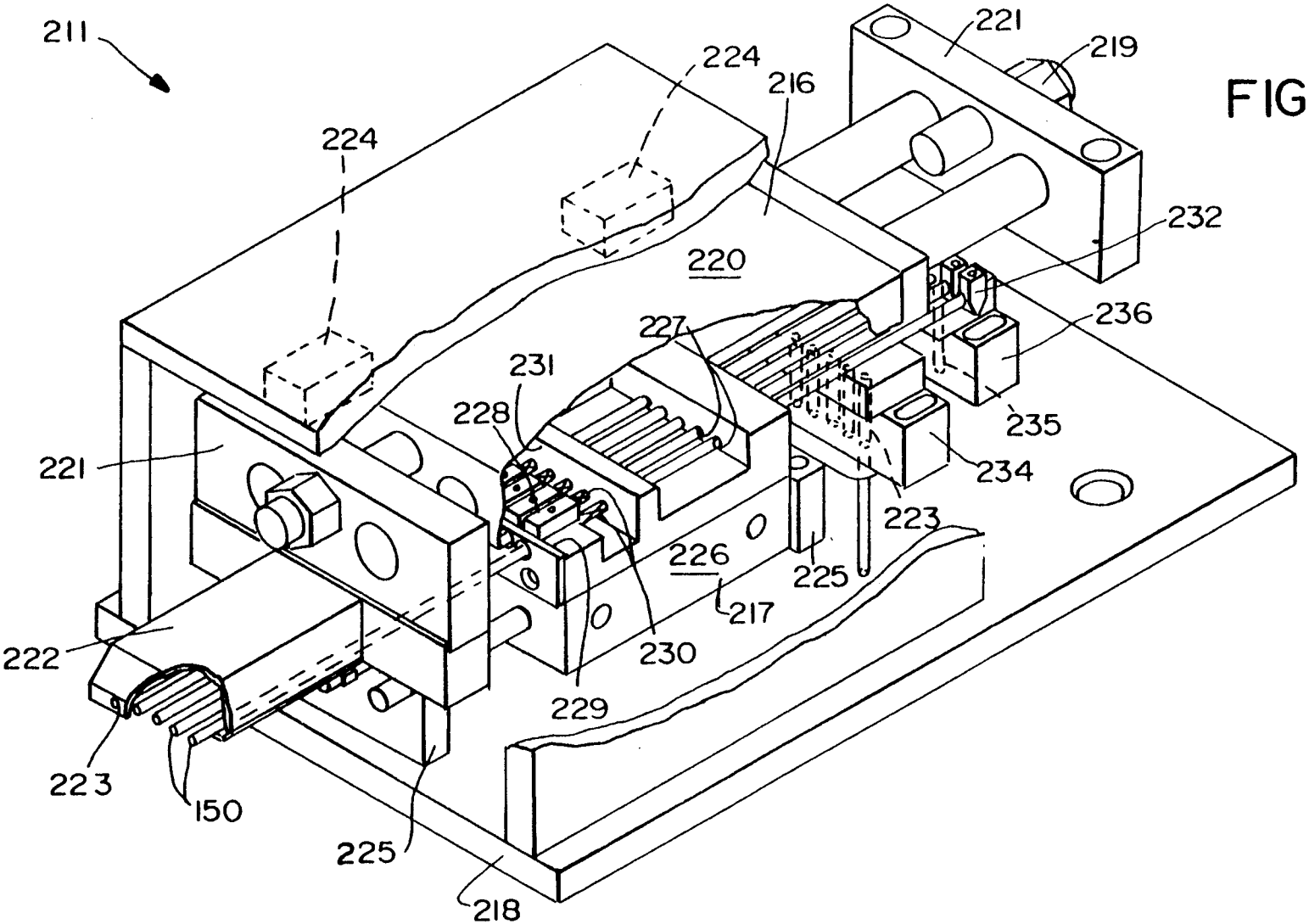
FIG. 13 is a perspective view partly broken away of the housing push subassembly of the housing insertion station shown in FIG. 12.

Housing push subassembly (FIG. 13) has two power slides 216, 217 mounted to insertion station frame 218. Power slide 216 is mounted so that center portion 220 is fixed to frame 218 and end portions 221 are reciprocally slidable. A housing push block 222 is fixed to one of end portions 221 so that actuation of power slide 216 reciprocally moves push block 222. Housing push block 222 has apertures 223 through which probes 150 extend towards terminals 156. Limit switches of known type 224 are provided to verify the position of power slide 216 so that the operation occurs in the proper sequence. The distance housing push block 222 can move housing 154 towards pitch adjustment subassembly 212 is adjustable through the use of nut and bolt assembly 219.

Power slide 217 is mounted so that end portions 225 are fixed to frame 218 while center portion 226 slides relative to the end portions and the frame. Center portion 226 bores 227 through which probes 150 extend and are slidable therein. One probe 150 is provided for each terminal 156.

The sliding movement of the probes is limited by stops 228 which are fixed to each probe and located between shoulder 229 and shoulder 231. Thus, probes 150 are only capable of limited travel relative to center portion 226. As described in further detail below, the springs 230 are compressed when the probes 150 contact terminals 156 during the end of the stroke of powerslide 217 as it moves to the left in FIG. 12. Thus, the probes are mounted on and extend through center portion 226 but the movement of center portion 226 horizontally also moves the probes horizontally through apertures 223 in push block 222 and into contact with terminals 156.

Proximity flags 232 are fixed to probes 150. One proximity sensor 233 for each probe 150 is provided at support 234. One additional proximity sensor 235 is provided in support 236 and aligned with the center probe to monitor that the probes are fully retracted when they are supposed to be so that a new housing can be loaded into the insertion station. Wires (not shown) are connected to each proximity sensor and connected to the system controller in known manner. Sensors 233 operates first to determine whether the terminals 156 are properly positioned and then to determine whether they are properly inserted into housing 154. Proximity sensor 235 is used to determine when the probes 150 have been retracted so that a new housing 154 can be loaded into the insertion station 126.

Figure 14:
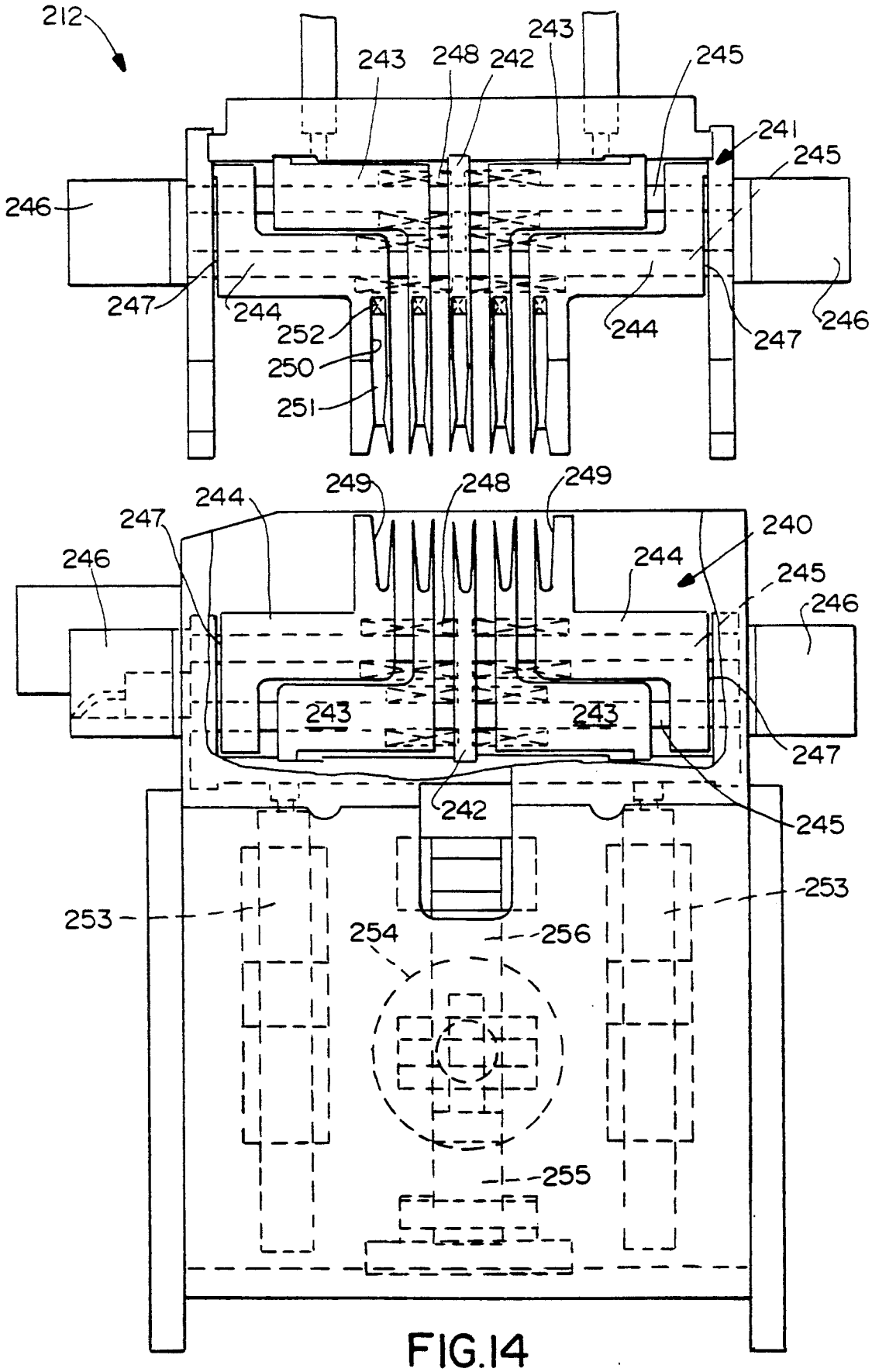
FIG. 14 is a front elevational view partly broken away of the pitch adjustment subassembly, of the housing insertion station shown in FIG. 12.

Pitch adjustment subassembly 212 (FIG. 14) includes similar lower and upper mechanisms 240 and 241 that are located below and above wires of cable 12, respectively. Each mechanism includes a fixed center arm 242 and inner moveable arms 243 located on opposed sides of center arm 242. Outer moveable arms 244 are located on the sides of inner arms 243 opposite center arm 242. Outer and inner arms 243 and 244 have bores therethrough and are slidably mounted on shafts 245. Pneumatic cylinders 246 are located adjacent the outside edge 247 of each outer arm. Upon actuating pneumatic cylinders 246, the shaft of each cylinder is forced into contact with the outside edge 247 of each outer arm 244 which in turn forces arm 244 towards center arm 242 and into contact with inner arm 243 so that outer arm 244 contacts inner arm 243 and the inner arm contacts center arm 242. Through such an arrangement, the gaps between the arms are eliminated upon actuation of the pneumatic cylinders and the pitch between the wires is changed. Springs 248 are provided between the arms to restore them to their original pitch after pneumatic cylinders 246 are retracted.

Each arm of lower subassembly 240 has a vertical wire receiving slot 249 located at the top thereof. Each arm of upper subassembly 241 also has a vertical slot 250 into which a wire contacting pin 251 is slidably located. A compression spring 252 is located in slot 250 to bias pin 251 in a lowered position. The spring actuated pins permit the use of different diameter wires and multiple wire without modification of the tooling.

In order to permit the pallets 36 to travel around track 34 of the system, each subassembly of the housing insertion station 126 has a mechanism for vertical movement so that each subassembly has a non-engaged position at which there is sufficient clearance so that the pallet can pass by the insertion station subassemblies. Each subassembly also has an engagement position at which wherein an operation is performed on the pallet or the cable wires.

Lower subassembly 240 is moveable vertically on slide bearings 253 through the use of pneumatic cylinder 254 and linkage arms 255 and 256. The lower arm 255 is pinned to frame 218 and the upper arm 256 is pinned to lower subassembly 235. As best shown in FIG. 12, by extending cylinder 254, linkage arms 255 and 256 will move lower subassembly 240 upward so that wires 12*c* and 12*d* engage wire receiving slots 249. By actuating pneumatic cylinder 270, shaft 271 forces upper subassembly 241 downward towards pallet 36.

Figure 19:
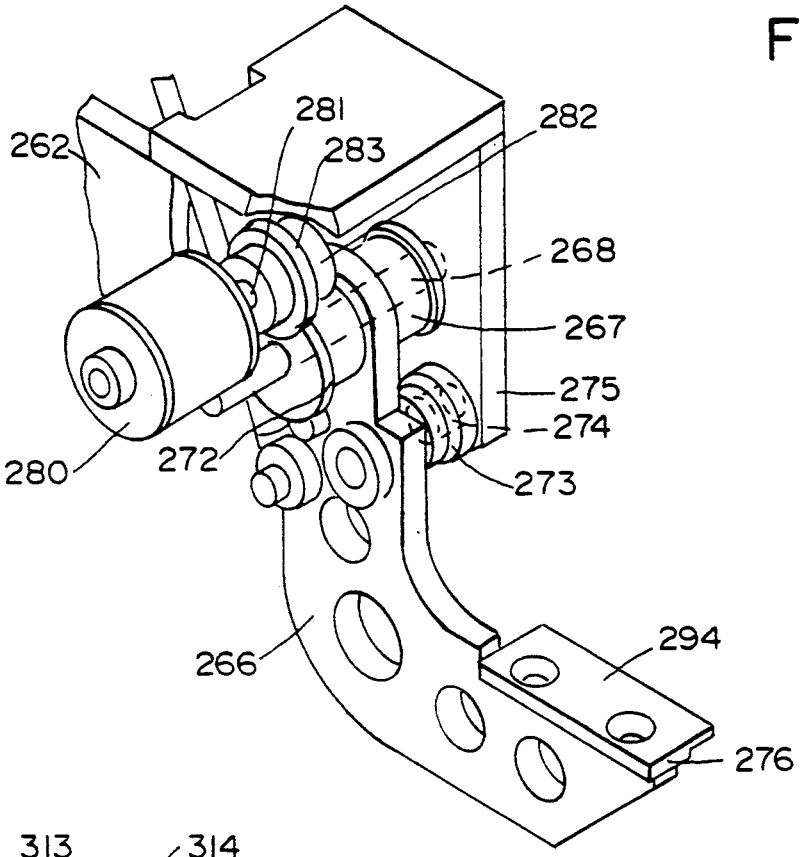
FIG. 19 is a perspective view of the swing arm assembly of FIG. 15.

Wire holding subassembly 213 (FIGS. 15 and 19) includes upper and lower mechanisms 260 and 261 mounted to plate 262. Upper mechanism 260 includes a power slide 263 fixed to plate 262. Block 264 is fixed to rods 269 of the power slide. A wire clamping block 265 made from a resilient material such as polyurethane is secured to block 264.

Lower mechanism 261 includes a rotatable arm 266 secured to cylindrical block 267 (FIG. 19) which is rotatably and slidably mounted on shaft 268. Block 267 has an annular rib 272 at its edge closest to plate 262. A locator block 273 (FIG. 19) having a bore for receiving shot pin 274 is also mounted to arm 266. Shot pin 274 is fixed to the portion of bracket 275 that is parallel to plate 262. A wire clamping block 276 is fixed to the end of arm 266 opposite shaft 268.

A first pneumatic cylinder 280 is mounted to plate 262 on the side opposite arm 266. The shaft 281 of cylinder 280 has mounted thereon a cylindrical block 282 having an annular rib 283. Cylinder 280 is located and blocks 267 and 282 are dimensioned so that annular rib 272 of block 266 is adjacent annular rib 283 of block 282.

Figure 15:
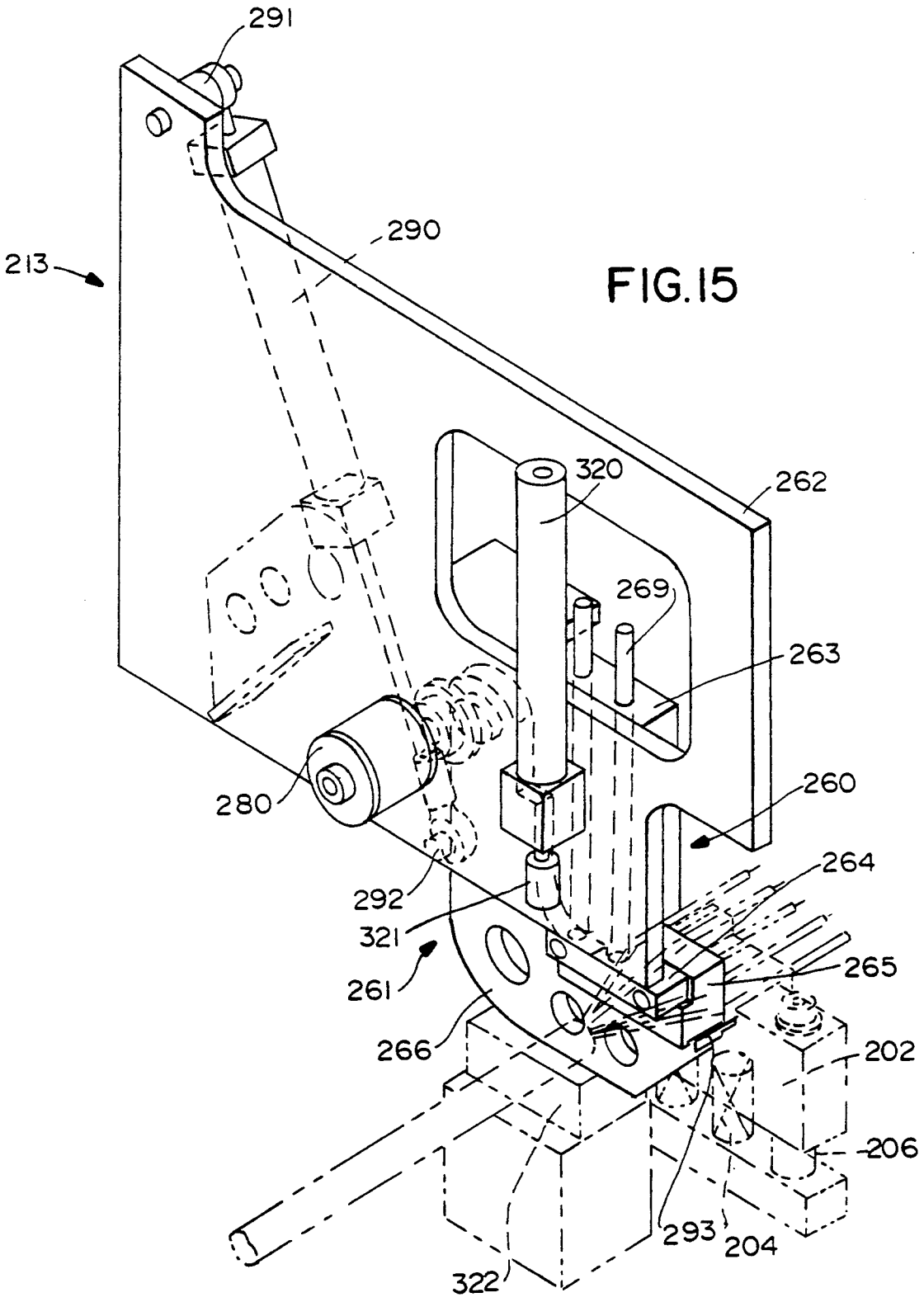
FIG. 15 is a perspective view of the wire holding subassembly of the housing insertion station shown in FIG. 12.

A second pneumatic cylinder 290 (FIG. 15) is provided wherein it is rotatably mounted to plate 262 at one end 291 and swively mounted to arm 266 at its other end 292. Thus, by extending cylinder 290, arm 266 swings through its range of motion from its non-engaged position (shown in phantom) to its engaged wire holding position as shown in FIGS. 12 and 15. Through activation of both upper and lower mechanisms 260 and 261, wires 12*c* and 12*d* are engaged between the lower face 293 of wire clamping block 265 and the wire clamping face 294 of arm 266.

A third pneumatic cylinder 320 is also mounted to plate 262. The actuation of this cylinder forces push block 321 downward and into contact with cable 12 to ensure it is securely held by its clamping fixture 322.

The subassembly 214 (FIG. 12) for depressing wire holder 200 is located between upper pitch adjustment mechanism 241 and wire holding subassembly 213. Subassembly 214 includes a pneumatic cylinder 295 which forces slide bearing 296 and block 297 attached thereto downward into contact with upper surface 298 (FIG. 16) of wire holder block 202. The force from cylinder 295 compresses springs 204 and forces the entire wire holder 200 downward. By actuating holder depressing subassembly 214 after activation of wire holding subassembly 213 and engagement of the wires 12*c* and 12*d* by pitch adjustment sub assembly 212, wires 12*c* and 12*d* are removed from the wire holder 200 while they are maintained on their pre-removal centerlines.

Figure 20:
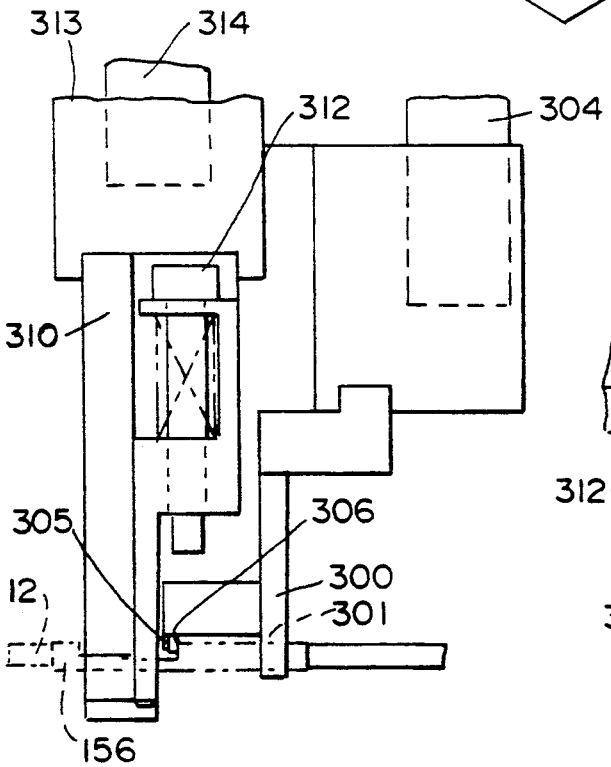
FIG. 20 is a detail side elevational view of a portion of the terminal positioning subassembly shown in FIG. 12.
Figure 21:
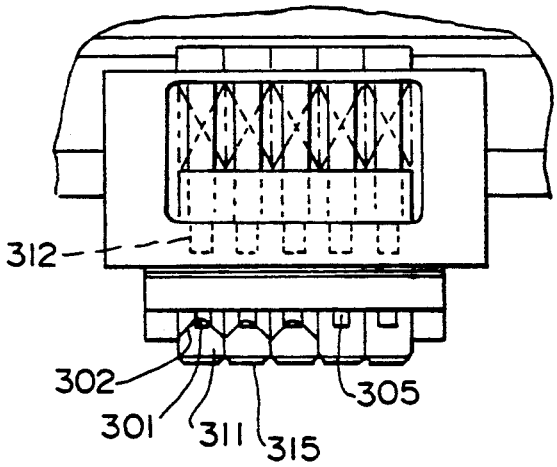
FIG. 21 is a detail rear elevational view of the portion of the terminal positioning subassembly shown in FIG. 20.

Terminal positioning subassembly 215 (FIGS. 20 and 21) includes a terminal alignment template 300 for centering each terminal along the desired centerline at nesting positions 302. Template 300 has tapered edges 301 that guide the terminals 156 into the terminal nesting positions 302 upon actuation of cylinder 303 which forces shaft 304 and alignment template attached thereto downward towards the terminals. Attached to the template 300 are axial positioning nibs 305 which contact shoulder 306 of terminals 156 when the terminals are properly positioned. A terminal support member 309 is mounted to lower pitch adjustment mechanism 240 in order to support the terminals to ensure that they are not below the proper height before mating with probes 150.

Subassembly 215 also includes a terminal rotating mechanism 310 which operates to ensure that none of the terminals 156 are rotated prior to insertion in the housing 154. Fingers 311 are spring loaded on bolts 312 which are secured to block 313 which in turn is fixed to the shaft of cylinder 314. Upon actuation of the cylinder, the fingers are moved downward so that the flat lower surface 315 of each finger contacts the flat portion of the crimp of each terminal. If the terminal is rotated, the force of the finger will rotate the terminal until the terminal is aligned with the crimp section facing upward. Fingers 311 also operate to close the cover (not shown) of housing 154 after terminals 156 have been inserted therein.

In operation, pallet 34 arrives at insertion station 126 with wires 12*c* and 12*d* loaded into wire holder 200 and terminals 156 crimped on the wires. After the pallet is seated at the station, pneumatic cylinder 254 is actuated which elevates lower pitch adjustment mechanism 240 so that wires 12*c* and 12*d* are located within wire receiving slots 249. The height adjustment mechanisms comprised of pneumatic cylinder 254 and lower and upper arms 255 and 256 are adjusted so that wires 12*c* and 12*d* and terminals 156 crimped thereon are maintained at the desired centerlines in order to permit mating with probes 150.

Upper pitch adjustment mechanism 241 (FIG. 14) is then lowered by actuating cylinder 270. The wire contacting pin 251 associated with each arm of upper subassembly 241 contacts the top surface of the wires and fixes the wires securely within wire receiving slot 249. The springs 252 are provided, in part, so that upper pitch adjustment mechanism 241 can be utilized without modification regardless of whether drop wires 12*d* are present in each terminal 156. That is, if a drop wire is present in one slot 249, the pin 251 associated with that slot will contact the drop wire before the pins associated with the other slots contact the wire in their respective slots. In such case, the spring 252 of the pin 251 that contacts the drop wire 12*d* will be compressed a greater amount than if a drop wire were not present.

Through such an arrangement, the wires are gripped between the wire holder 200 and terminals 156. It should be noted that a sufficient length of each wire extends axially beyond the pitch adjustment subassembly 212 towards housing 154 so that the housing can be slid onto terminals 156 without the housing contacting the pitch adjustment subassembly 212.

The lower and upper mechanisms 260 and 261 (FIG. 15) of wire holding subassembly 213 are then operated to secure the wires 12*c* and 12*d* on the side of wire holder 200 opposite pitch adjustment subassembly 212. Pneumatic cylinder 290 is actuated to swing rotatable arm 266 from its non-engaged position to its engaged position whereat wire clamping face 294 of rotatable arm 266 is positioned to support wires 12*c* and 12*d*. Pneumatic cylinder 280 is then actuated which forces block 282 into contact with arm 266 adjacent shaft 268 and thus slides arm 266 on shaft 268 away from plate 262. During the sliding motion, shot pin 274 mates with the bore in locator block 273. Arm 266 is secured in this manner to provide a mechanical barrier to prevent rotation rather than relying solely upon the force of pneumatic cylinder 290. As a result, powerslide 263 can exert a greater force on wire clamping face 294 in order to securely retain wires 12*c* and 12*d*.

After arm 266 is secured in place, powerslide 263 is an actuated to force wire clamping block 265 downward towards wires 12*c* and 12*d* so that the lower face 293 of that block contacts the wires and secures them between the lower face 293 and wire clamping face 294 of rotatable arm 266. Cylinder 320 is also actuated to force cable 12 downward into its clamping fixture 322.

At this point, the wires 12*c* and 12*d* are supported on both sides, in an axial direction, of wire holder 200. Pneumatic cylinder 295 (FIG. 12) of the subassembly 214 for depressing the wire holder 200 is then actuated which forces arm 296 and pusher block 297 downward to engage the upper surface 298 of block 202 and force the block 202 and wire retainer 207 downward, thus compressing springs 204. By supporting the wires 12*c* and 12*d* on opposite sides of wire holder 200 and then pushing the wire holder downward, the wires are removed from wire holder 200 without changing their centerline.

Once the wires 12*c* and 12*d* have been removed from wire holder 200, pneumatic cylinders 246 of the pitch adjustment subassembly 212 are actuated to compress the inner and outer arms 242 and 243 of lower and upper pitch adjustment mechanisms 240 and 241 to force the wires and the terminals attached thereto into the desired pitch.

Terminal alignment plate 300 (FIGS. 20 and 21) is then lowered by actuating cylinder 303. If the terminals are located to the side of the correct centerline, they will contact tapered edges 301 of the template and be guided by the taper into terminal nesting position 302 located at the apex of the taper. Vertical alignment occurs through the terminals contacting terminal support member 309 and template 300 at terminal nesting position 302. At this point, terminals 156 are supported between terminal support member 309 and template 300.

The various clamps securing the wires 12*c* and 12*d* are then released so that the terminals can be located in the axial direction prior to insertion into housing 154. Powerslide 263 is retracted to raise block 265 off of the wires. Cylinder 280 is retracted to pull arm 266 along shaft 268 towards plate 262 so that shot pin 274 disengages from locator block 273. Arm 266 is then rotated back to its non-engaged position by retracting cylinder 290. Cylinder 270 is retracted which raises upper pitch adjustment mechanism 241 and so that pins 251 no longer contact wires 12*c* and 12*d* to retain them within slots 249. Accordingly, wires 12*c* and 12*d* together with the terminals 156 attached thereto are free to move in the axial direction only.

Power slide 217 is actuated so that center portion 226 and probes 150 are moved towards the terminals 156 (to the left in FIG. 12). Near the end of the power slide's travel towards pitch adjustment subassembly 212, probes 150 contact the terminals and force them towards that subassembly until shoulder 306 (FIG. 20) of each terminal contacts axial positioning nib 305. Once the terminals are positioned against nib 305, any additional movement of power slide 217 results in the probes mating with the terminals and compression of spring 230.

Cylinder 314 is actuated at this point to lower terminal rotating mechanism 310. The lower flat surface 315 of each finger 311 contacts the flat crimp section of terminal 156 and rotates it if necessary so that the flat crimp section contacts surface 315. Through this operation, all of the terminals will be aligned radially.

Each terminal should now be accurately positioned and the system controller then monitors the status of the proximity sensors 233 to determine whether the proximity flags 232 are all in the correct position, thus indicating correct positioning of the terminals 156 and the probes 150.

If the terminals and probes are not in the correct position, an error signal is generated by the system controller. Absent such a signal, cylinder 270 is actuated to lower upper pitch adjustment mechanism to reclamp the wires 12? and 12*d* in slots 249 with pins 251. Cylinders 303 and 314 are then retracted to disengage the terminal positioning subassembly from the terminals 156. The terminals are then supported only by probes 150 and the wires supported only by pitch adjustment mechanism 212.

At this time, housing power slide 216 is actuated to move end portion 221 and push block 221 towards terminals 156. Such movement forces a housing 154 over the terminals 156 in a gang-loading operation. Cylinder 314 is then actuated again to force fingers 311 down to close a cover (not shown) located at the top surface of the housing 154. Once the push block 216 has completed its stroke towards terminals 156, the system controller again monitors the proximity sensors 233 to determine that all of the terminals were fully inserted into the housing. If, for example, one terminal were not fully inserted, the probe in contact with that terminal would be further to the left as viewed in FIG. 12 and the system controller would generate an error signal.

Both power slides 216 and 217 are then retracted to withdraw the probes 150 from the terminals 156 and disengage the push block 222 from the housing 154. Cylinder 270 is retracted to raise upper pitch adjustment mechanism 241 and thus release wires 12*c* and 12*d* from slots 249. Cylinder 254 is retracted to lower the lower pitch adjustment mechanism 240. Cylinder 295 is retracted to release wire holder 200 and permit the pallet 34, having a completed harness, to advance to an unload station or a station for further processing.

While the invention has been described with respect to certain preferred embodiments, it is apparent that various changes can be made without departing from the scope of the invention as defined by the appended claims.

We claim:

1. An apparatus for producing wire harness assemblies, each assembly comprising a plurality of cable wires having opposed ends with terminals mounted to said wires at one end of said cable wires and a housing at one of said ends with at least one of said terminals mounted therein, said apparatus comprising an insertion station for inserting the terminals into the housing, wherein the improvement comprises:

at least one probe assembly at the insertion station, said probe assembly comprising a plurality of probes corresponding in number to a maximum number of terminals, each said probe being configured to engage a corresponding terminal;

means for moving the probes selectively into and out of engagement with the terminals;

means for moving the housing relative to the terminals and the probes such that the probes guide the housing on the terminals; and rotating means for rotating said terminals so that said terminals are all oriented in the same predetermined orientation during insertion into said housing.

2. An apparatus as in claim 1 further comprising test means for sensing that the terminals are in a predetermined, desired location.

3. An apparatus as in claim 1 further comprising means for supporting said terminals at said insertion station in a first plane prior to said probes engaging their respective terminals, means for aligning said terminals in a second plane, perpendicular to said first plane, prior to said probes engaging their respective terminals.

4. An apparatus as in claim 3 further comprising means for moving said terminals axially to a desired, predetermined position prior to insertion into said housing.

5. An apparatus as in claim 4 further comprising test means for sensing whether the terminals are in their desired, predetermined position prior to insertion into said housing.

6. An apparatus as in claim 5 wherein said probes comprise a portion of said test means.

7. An apparatus as in claim 1 wherein said rotating means comprises a member for contacting a crimped portion of said terminals.

8. An apparatus as in claim 5 further comprising second test means for sensing whether said terminals are properly inserted into said housing.

9. An apparatus as in claim 1 wherein said means for moving said housing relative to the terminals and the probes comprises means for moving the housing while the terminals and probes remain relatively fixed.

10. An apparatus for producing wire harness assemblies, each assembly comprising a plurality of wires having a terminal mounted to an end of each said wire and a housing with said plurality of said terminals mounted therein, said apparatus comprising an insertion station for positioning the terminals into the housing, said apparatus comprising:

support means for supporting said end of each said wire having a terminal mounted thereon at said insertion station on a first axis perpendicular to a terminal axis along said terminal;

alignment means for aligning each said terminal on a second axis perpendicular to said first axis and said terminal axis;

a plurality of probes corresponding in number to a maximum number of terminals, each said probe being configured to engage a corresponding terminal;

means for moving the probes relative to said terminals to bring them selectively into and out of engagement with the terminals;

means for moving said terminals along said terminal axis to position said terminals in a desired, predetermined position; and means for moving the housing relative to the terminals and the probes such that terminals are located within the housing and said probes guide the housing on the terminals.

11. An apparatus as in claim 10 further comprising first test means for sensing whether the terminals are in their desired, predetermined position after engagement of said terminals by said probes and second test means for sensing whether said terminals are properly positioned within said housing.

12. An apparatus as in claim 11 wherein said first and second test means comprise sensors that monitor the relative positions of said probes.

13. An apparatus as in claim 10 wherein said probes project through terminal receiving openings in said housing upon said probes engaging said terminals.

14. An apparatus as in claim 11 wherein said probes project through terminal receiving openings in said housing upon said probes engaging said terminals.

15. An apparatus as in claim 10 further comprising means for rotating said terminals about said terminal axis.

16. An apparatus as in claim 10 wherein said means for moving said housing relative to the terminals comprises means for moving the housing while the terminals remain relatively fixed along said terminal axis.

17. An apparatus for producing wire harness assemblies, each assembly comprising a plurality of wires having a terminal mounted to an end of each said wire and a housing with said plurality of said terminals mounted therein, said apparatus comprising an insertion station for positioning the terminals into the housing, said apparatus comprising:

support means for supporting said end of each said wire having a terminal mounted thereon at said insertion station on a first axis perpendicular to a terminal axis along said terminal;

alignment means for aligning each said terminal on a second axis perpendicular to said first axis and said terminal axis;

a plurality of probes corresponding in number to a maximum number of terminals to be mounted in said housing, each said probe being configured to engage a corresponding terminal;

means for moving the probes relative to said terminals to bring them selectively into and out of engagement with the terminals;

means for moving said terminals along said terminal axis to position said terminals in a desired, predetermined position; and means for moving the housing relative to the terminals and the probes to simultaneously load said plurality of terminals into the housing and wherein said probes guide the terminals into the housing during such simultaneous loading.

18. An apparatus as in claim 17 wherein said means for moving said housing relative tot he terminals comprises means for moving the housing while the terminals remain relatively fixed along said terminal axis.

* * * * *